US010610442B2

(12) United States Patent
Ishiguro et al.

(10) Patent No.: US 10,610,442 B2
(45) Date of Patent: Apr. 7, 2020

(54) MASSAGE DEVICE

(71) Applicant: DAITO ELECTRIC MACHINE INDUSTRY COMPANY LIMITED, Higashi-Osaka-shi, Osaka (JP)

(72) Inventors: Fumitaka Ishiguro, Higashi-Osaka (JP); Tetsuya Ishikawa, Higashi-Osaka (JP); Shinsaku Shimizu, Higashi-Osaka (JP)

(73) Assignee: DAITO ELECTRIC MACHINE INDUSTRY COMPANY LIMITED, Higashi-Osaka-Shi (JP)

( * ) Notice: Subject to any disclaimer, the term of this patent is extended or adjusted under 35 U.S.C. 154(b) by 1086 days.

(21) Appl. No.: 14/912,676

(22) PCT Filed: Jul. 24, 2014

(86) PCT No.: PCT/JP2014/069545
§ 371 (c)(1),
(2) Date: Feb. 18, 2016

(87) PCT Pub. No.: WO2015/129066
PCT Pub. Date: Sep. 3, 2015

(65) Prior Publication Data

US 2016/0193105 A1 Jul. 7, 2016

(30) Foreign Application Priority Data

Feb. 27, 2014 (JP) ..... 2014-036913
Jul. 11, 2014 (JP) ..... 2014-143214

(51) Int. Cl.
*A61H 7/00* (2006.01)
*A61H 15/00* (2006.01)

(52) U.S. Cl.
CPC ..... *A61H 7/007* (2013.01); *A61H 15/0078* (2013.01); *A61H 2015/0028* (2013.01);
(Continued)

(58) Field of Classification Search
CPC ..... A61H 7/00; A61H 7/001; A61H 7/002; A61H 7/004; A61H 7/007;
(Continued)

(56) References Cited

U.S. PATENT DOCUMENTS 6,190,339 B1 2/2001 Imazaike et al.
6,200,282 B1 * 3/2001 Furuie ..... A61H 7/007 601/98
(Continued)

FOREIGN PATENT DOCUMENTS

CN 1177473 A 4/1998
CN 2477169 Y 2/2002
(Continued)

OTHER PUBLICATIONS

International Search Report, issued in PCT/JP2014/069545, dated Aug. 26, 2014.

*Primary Examiner* — Michael J Tsai
(74) *Attorney, Agent, or Firm* — Birch, Stewart, Kolasch & Birch, LLP

(57) ABSTRACT

There is provided a massage device for performing a grabbing massage such as to grab a to-be-massaged area.

The massage device (1) comprises: a kneading massage member (2) having a kneading massager (9) at its front end; and a grabbing massage member (8) having a grabbing massager (7) at its front end, which is disposed on the base end side of the kneading massage member (2), and, the grabbing massage member (8) is designed to perform a grabbing massage by moving the grabbing massager of the grabbing massage member (8) close to and away from the kneading massager (9).

8 Claims, 17 Drawing Sheets

(52) U.S. Cl.
CPC .. *A61H 2201/0149* (2013.01); *A61H 2201/12* (2013.01); *A61H 2201/1215* (2013.01); *A61H 2201/1427* (2013.01); *A61H 2201/1623* (2013.01); *A61H 2201/1654* (2013.01); *A61H 2201/1669* (2013.01); *A61H 2201/1678* (2013.01); *A61H 2205/081* (2013.01)

(58) Field of Classification Search
CPC .... A61H 2201/0134; A61H 2201/0138; A61H 2201/0142; A61H 2201/0146; A61H 2201/0149; A61H 2201/1418; A61H 2201/1436; A61H 2201/1454; A61H 2201/149; A61H 2201/1481
See application file for complete search history.

(56) References Cited

U.S. PATENT DOCUMENTS

2005/0192520 A1* 9/2005 Morita ..... A61H 7/00 601/99
2007/0149907 A1* 6/2007 Ting ..... A61H 7/007 601/99
2007/0299377 A1 12/2007 Shiraishi
2008/0077060 A1* 3/2008 Liang ..... A61H 7/007 601/99
2008/0312568 A1* 12/2008 Chen ..... A61H 15/0078 601/122
2008/0312569 A1* 12/2008 Chen ..... A61H 7/007 601/134
2009/0149784 A1 6/2009 Morita et al.
2009/0149785 A1* 6/2009 Canto Garcia .... A61H 15/0078 601/99
2010/0081972 A1* 4/2010 Kan ..... 601/99
2012/0215143 A1* 8/2012 Inada ..... A61H 1/003 601/112
2016/0008212 A1* 1/2016 Chen ..... A61H 15/0078 601/112
2016/0193105 A1 7/2016 Ishiguro et al.

FOREIGN PATENT DOCUMENTS

| | | | | |
|---|---|---|---|---|
| CN | 1660025 | A | | 8/2005 |
| CN | 2922880 | Y | | 7/2007 |
| CN | 101068624 | A | | 11/2007 |
| CN | 101244009 | A | | 8/2008 |
| CN | 101267792 | A | | 9/2008 |
| CN | 101711717 | A | | 5/2010 |
| CN | 201642760 | U | | 11/2010 |
| CN | 107080676 | | * | 8/2017 |
| CN | 108743275 | | * | 11/2018 |
| EP | 1 433 454 | A1 | | 6/2004 |
| JP | 64-83260 | A | | 3/1989 |
| JP | 2003-102798 | A | | 4/2003 |
| JP | 2006-34635 | A | | 2/2006 |
| JP | 4046702 | B2 | | 2/2006 |
| JP | 4096925 | B2 | | 6/2008 |
| JP | 4194806 | B2 | | 12/2008 |
| JP | 2010-82064 | A | | 4/2010 |
| JP | 2012-10853 | A | | 1/2012 |
| JP | 2012-147839 | A | | 8/2012 |
| KR | 10-2005-0087722 | A | | 8/2005 |
| TW | 201012462 | A1 | | 4/2010 |
| WO | WO 2006/059431 | A1 | | 6/2006 |
| WO | WO 2014/027494 | A1 | | 2/2014 |
| WO | WO 2015/129066 | A1 | | 9/2015 |

* cited by examiner

MASSAGE DEVICE

TECHNICAL FIELD

The present invention relates to a massage device.

BACKGROUND ART

Where a backrest of a chair-type massage apparatus is concerned, there is a heretofore known a backrest which is internally provided with a massage device for imparting massage action to a pair of right and left massage members.

As a device of this type, there is proposed a back-kneading device equipped with an advancing-retracting system capable of driving a massage member to move forward beyond a normal massage position, as well as to return to its original position, to suit the needs or preferences of a user (for example, refer to Patent literature 1).

In this advancing-retracting system, a support frame, which is moved up and down within the backrest by a vertical movement mechanism, is provided independently of the massage device, and, the massage device is supported on the support frame so that the upper end of the massage device can be rocked back and forth about the lower part thereof acting as a pivotal point. Moreover, the mutually corresponding upper parts of the support frame and the massage device are driven to move close to and away from each other in a front-rear direction (back-and-forth driving).

PRIOR ART REFERENCE

Patent Literature

Patent literature 1: Japanese Unexamined Patent Publication JP-A 2003-102798

SUMMARY OF THE INVENTION

Problems to be Solved by the Invention

In the chair-type massage apparatus equipped with the back-kneading device as disclosed in Patent literature 1, with the aim of providing more efficacious massage feeling, the advancing-retracting system is used to move the massage member forward beyond a normal massage position, as well as to return to its original position.

However, in recent years, there arise demands for a wider variety of massage feelings, and more specifically, for example, there is a user's request asking a grabbing massage which is effected by grabbing his/her shoulders. That is, the massage device disclosed in Patent literature 1 is not adapted to achieve such a desired massage.

The present invention has been devised in view of the circumstances as mentioned supra, and accordingly its object is to provide a massage device capable of performing a grabbing massage on a target body area to be massaged by grabbing the area between a kneading massage member and a grabbing massage member.

Means for Solving the Problem

In order to solve the above problem, the following technical means is adopted for the implementation of a massage device pursuant to the present invention.

That is, a massage device pursuant to the present invention comprises: a kneading massage member having a kneading massager at its front end; and a grabbing massage member having a grabbing massager at its front end, which is disposed on the base end side of the kneading massage member. Said grabbing massage member is designed to perform a grabbing massage by moving the grabbing massager of the grabbing massage member close to and away from said kneading massager.

It is preferable that the massage device is further provided with a rotation shaft which is driven to rotate about an axis pointing in a horizontal direction; and a kneading drive section for rocking said kneading massage member by taking out a rotative driving force of said rotation shaft to allow the kneading massage member to perform a kneading massage.

It is preferable that the massage device is further provided with a rotation shaft which is driven to rotate about an axis pointing in a horizontal direction; and a grabbing drive section for moving said grabbing massager close to and away from the kneading massager by utilizing a rotative driving force of said rotation shaft.

It is preferable that said grabbing drive section comprises: a grabbing boss portion having a cam face formed on its outer peripheral surface, which is eccentrically attached to said rotation shaft; an annular engagement portion engaged with the cam face of said grabbing boss portion, for taking out said rotative driving force; and a crank member having its base end connected to said annular engagement portion, and has its front end connected to said grabbing massage member, for transmitting the produced rotative driving force to said grabbing massage member, and that, in said grabbing massage member, its base end is pivotally supported on said kneading massage member for free rotation about a horizontal axis relative to its front end fitted with said grabbing massager, and the front end of said crank member is coupled to an intermediate part of said grabbing massage member for free rotation about an axis pointing in the horizontal direction.

It is preferable that said grabbing drive section comprises: a grabbing boss portion having a cam face formed on its outer peripheral surface, which is eccentrically attached to said rotation shaft; an annular engagement portion engaged with the cam face of said grabbing boss portion, for taking out said rotative driving force; a guide pin formed in said kneading massage member or said grabbing massage member; a guide groove formed in said grabbing massage member or said kneading massage member, in which said guide pin is slidably moved; and a coupling member having its base end connected relatively to said annular engagement portion, and having its front end connected for free rotation about a horizontal axis relatively to the base end of the grabbing massage member.

It is preferable that said kneading drive section comprises: a kneading boss portion which is attached to the rotation shaft fitted with said grabbing boss portion, and has, on its outer peripheral surface, an inclined cam face inclined with respect to the axis of said rotation shaft; and a kneading engagement portion engaged with the inclined cam face of said kneading boss portion, for taking out said rotative driving force, that said kneading engagement portion is formed at the base end of said kneading massage member, and that a swing restraining mechanism for retraining said kneading massage member against co-rotation with the kneading boss portion is disposed on a lateral side of the base end of said kneading massage member.

It is preferable that said kneading boss portion is eccentrically attached to said rotation shaft, and that an eccentric direction of the grabbing boss portion with respect to said rotation shaft and an eccentric direction of the kneading boss portion with respect to said rotation shaft are circumferentially different from each other.

It is preferable that said kneading massager is located at each side of the front end of the kneading massage member in a width direction, and that a grabbing massage is performed by moving the grabbing massager close to and away from the widthwise inner kneading massager.

It is preferable that said grabbing drive section comprises: a grabbing boss portion which is attached to said rotation shaft for unitary rotation, and has, on its outer peripheral surface, a cam face which is eccentric with respect to the axis of said rotation shaft; and a crank member which has, at its base end side, an annular engagement portion engaged with the cam face of said grabbing boss portion so as to take out said rotative driving force, and transmits the produced rotative driving force toward a front end side thereof, that said grabbing massage member has its base end side pivotally supported on the front end side of said crank member for free rotation about a horizontal axis, and said grabbing massager is disposed at the front end side of said grabbing massage member, and that an intermediate part of said grabbing massage member is coupled to said kneading massage member for free rotation about an axis pointing in the horizontal direction.

It is preferable that said kneading drive section comprises: a kneading boss portion which is attached to the rotation shaft fitted with said grabbing boss portion, and has, on its outer peripheral surface, an inclined cam face inclined with respect to the axis of said rotation shaft; and a kneading engagement portion engaged with the inclined cam face of said kneading boss portion, for taking out said rotative driving force, that said kneading engagement portion is formed at the base end of said kneading massage member, and said kneading massager is disposed at the front end of the kneading massage member, and that the base end of said kneading massage member is formed with a protrusion extending in the opposite direction to said kneading massager with reference to said rotation shaft, and said grabbing massage member is coupled to the front end of said protrusion.

Advantageous Effects of the Invention

According to the massage device pursuant to the present invention, a grabbing massage can be performed on an area to be massaged by grabbing the area between the kneading massage member and the grabbing massage member.

MODES FOR CARRYING OUT THE INVENTION

First Embodiment

Hereinafter, an embodiment of a massage device 1 pursuant to the present invention will be described in detail with reference to drawings.

FIGS. 1 to 6 show the massage device 1 implemented as the first embodiment.

Figure 1:
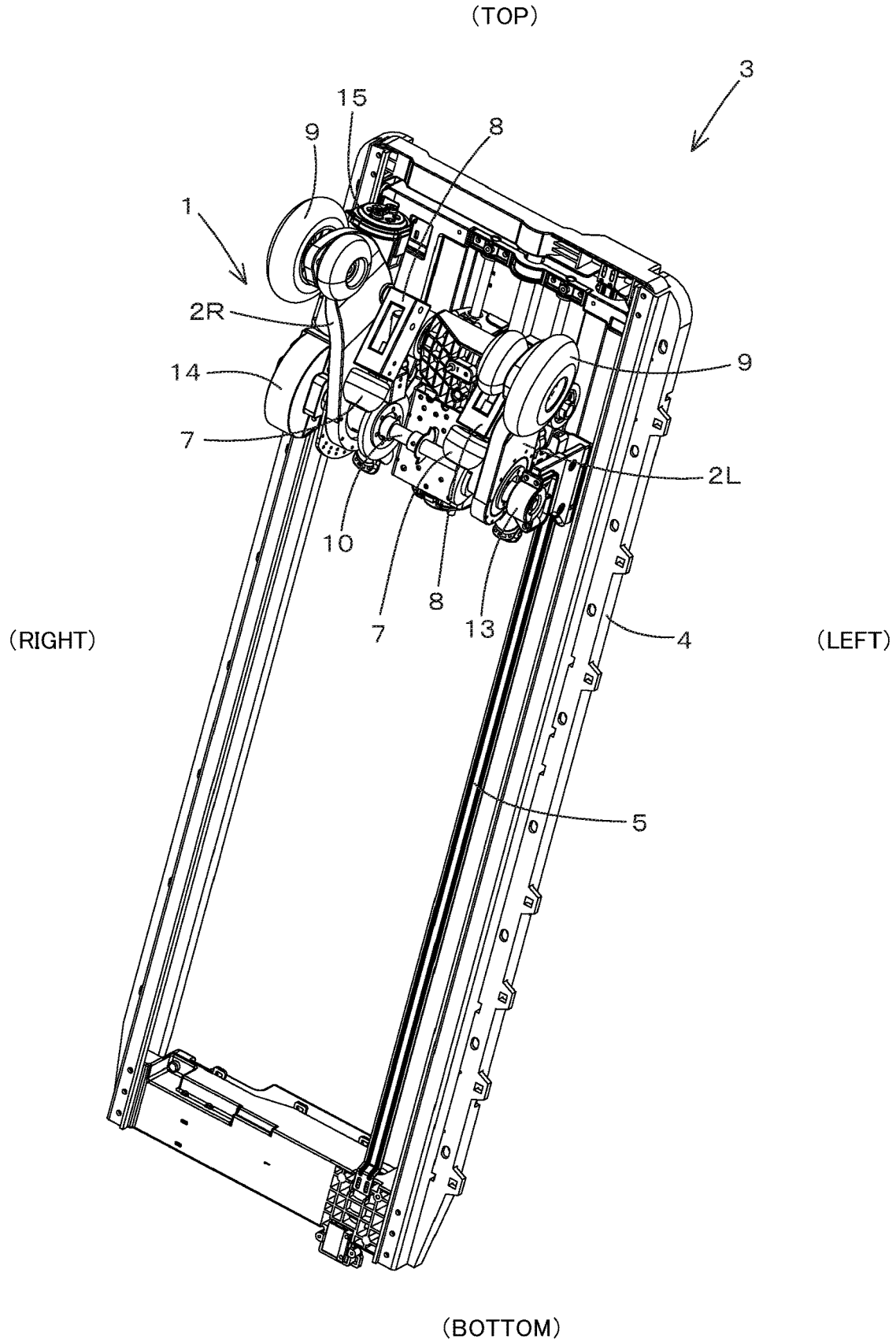
FIG. 1 is a perspective view showing a massage device implemented as the first embodiment as a whole.

As shown in FIG. 1, the first embodiment is an example in which the massage device 1 pursuant to the present invention is installed in a back-kneading device 3 of a backrest of a chair-type massage apparatus. Specifically, this chair-type massage apparatus comprises a seat having an area wide enough for supporting the buttocks of a user from below, and a backrest mounted at the rear of the seat. The backrest is internally provided with a back-kneading device 3 for performing a kneading or tapping massage on user's body over a wide range extending from the shoulder to the back, and from there to the waist, and, in the first embodiment, the massage device 1 pursuant to the present invention is applied to this back-kneading device 3.

In the following description as to the massage device 1, as shown in FIG. 1, the direction of height of the backrest of the chair-type massage apparatus in an upstanding condition will be defined as a vertical direction, and, on the basis of the vertical direction, a right-left, or horizontal direction and a front-rear direction are defined for the sake of explanation. The definitions of the above directions conform to a vertical direction, a horizontal direction, and a front-rear direction, respectively, based on the sight of a user sitting on the chair-type massage apparatus. In order to clarify the relationship between the directions indicated in the drawings and the actual directions associated with the device, the vertical direction (height direction), the horizontal direction (width direction), and the front-rear direction as used in the description of the present embodiment will be specified in representative drawings.

The backrest is, at its lower end, pivotally mounted on the rear of the seat, so that the upper end of the backrest is capable of reclining movement in the front-rear direction about the lower end. The above-described back-kneading device 3, or equivalently the massage device 1 of the first embodiment is installed inside the backrest.

Specifically, as shown in FIG. 1, the above-described back-kneading device 3 comprises: the massage device 1; a base member 4 for supporting the massage device 1; and an up-and-down moving mechanism 5 for allowing the base member 4 to move in the vertical direction within the backrest. In the backrest, by moving the base member 4 and the massage device 1 supported by the base member 4 in the vertical direction by operating the up-and-down moving mechanism 5, it is possible to press the massage device 1 against an area to be massaged at the back of a user, thereby performing a massage.

Figure 2A:
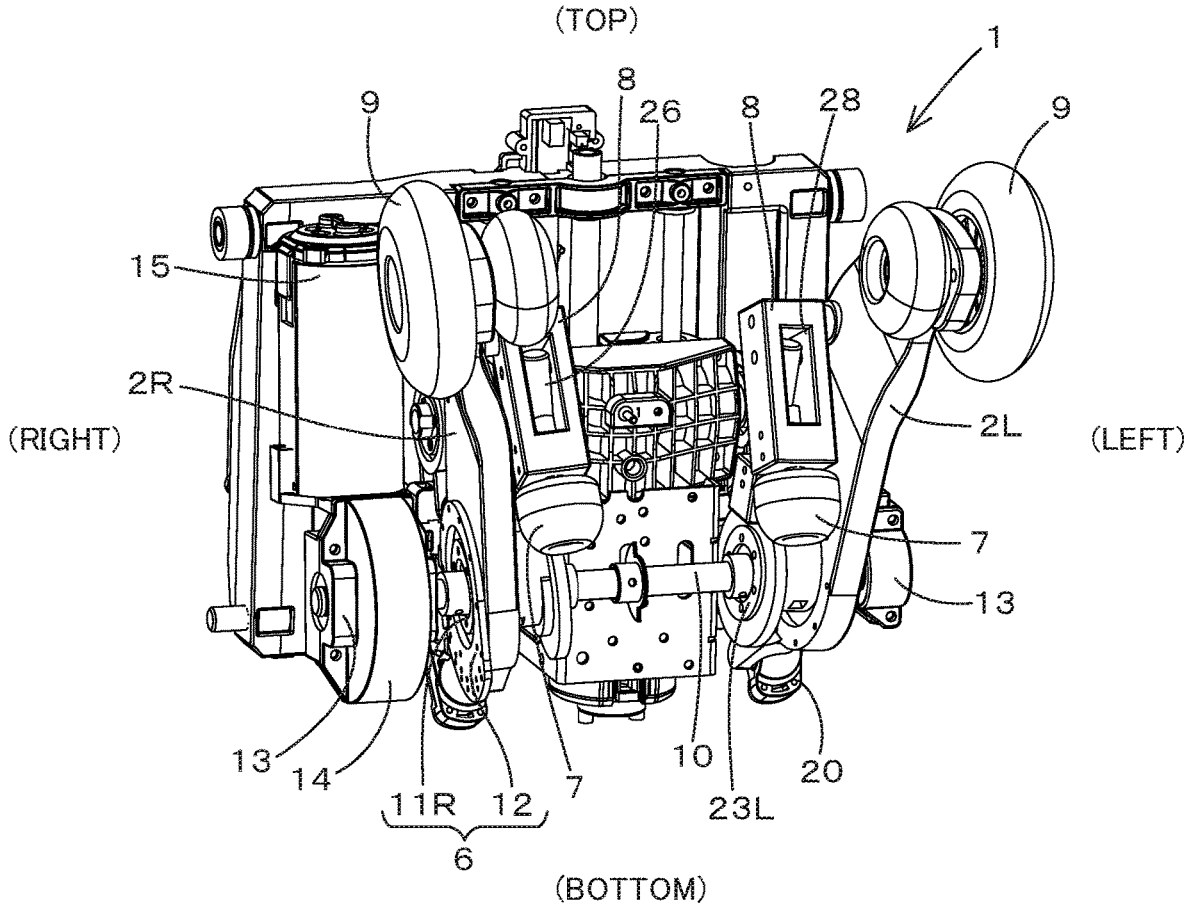
FIG. 2A is a perspective view of the massage device of the first embodiment, with the grabbing massage member located away from the kneading massage member.
Figure 2B:
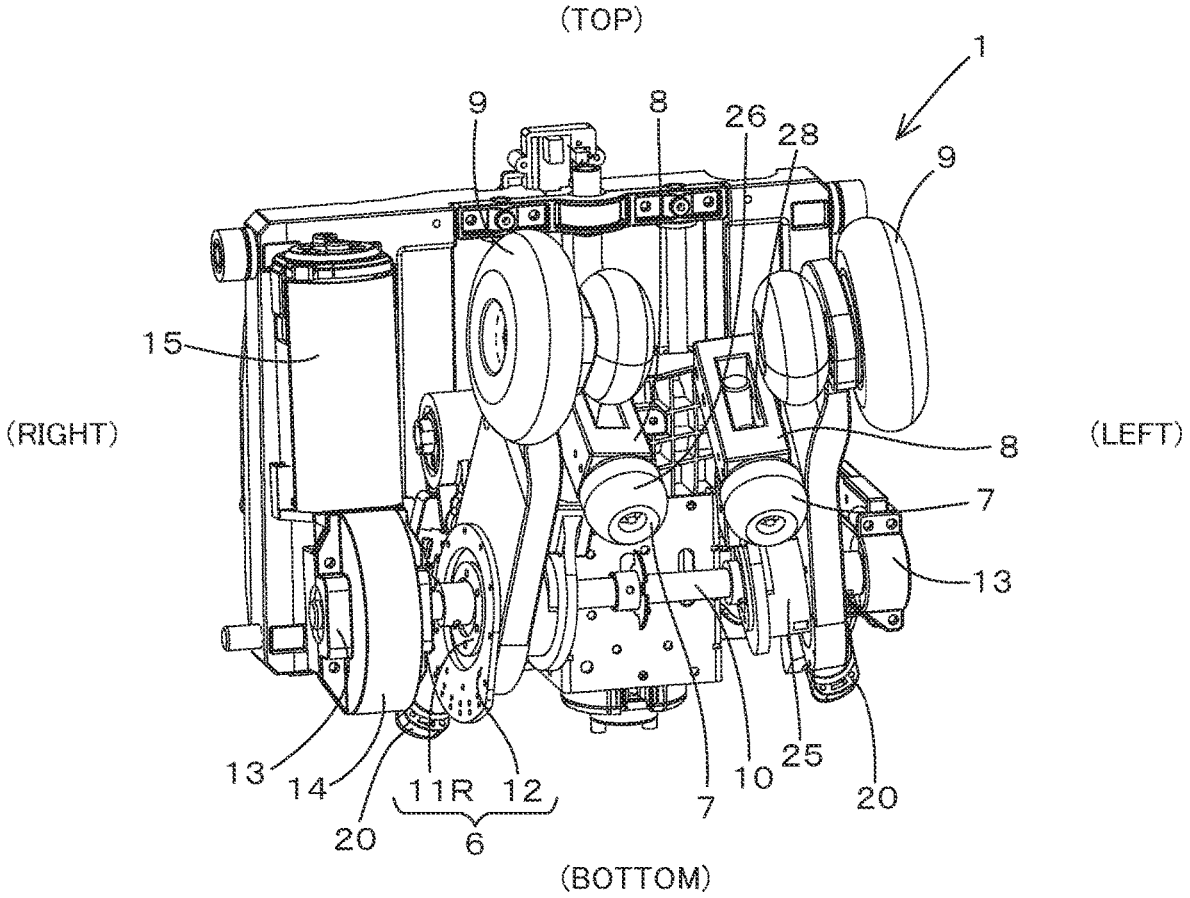
FIG. 2B is a perspective view of the massage device of the first embodiment, with the grabbing massage member located close to the kneading massage member.
Figure 6:
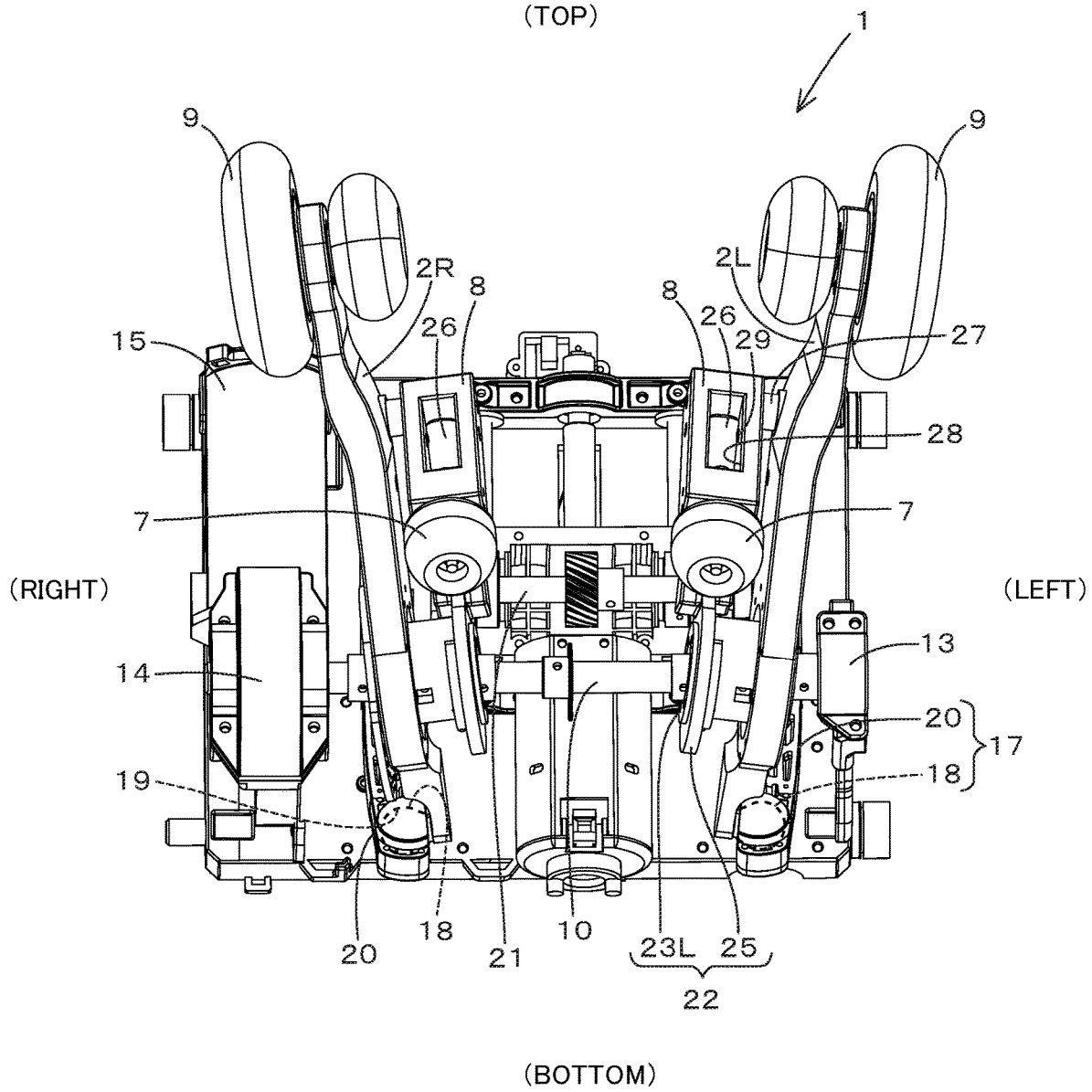
FIG. 6 is an upward view of the massage device of the first embodiment when viewed from the bottom on the front side.
Figure 7A:
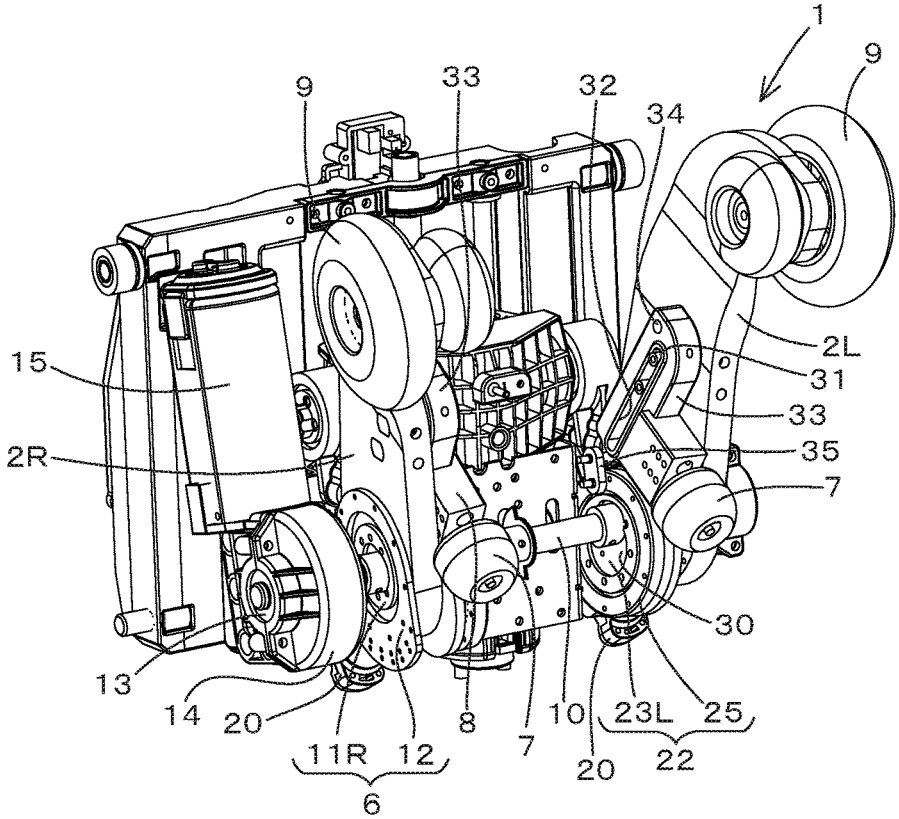
FIG. 7A is a perspective view of the massage device of the second embodiment, with the grabbing massage member located away from the kneading massage member.
Figure 7B:
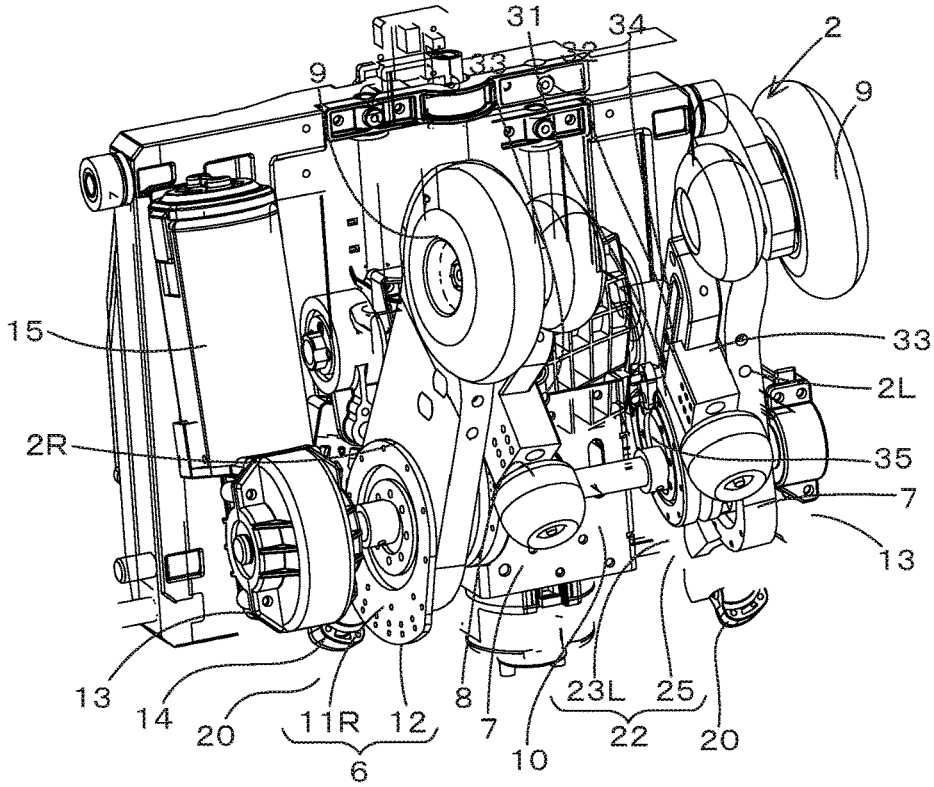
FIG. 7B is a perspective view of the massage device of the second embodiment, with the grabbing massage member located close to the kneading massage member.

As shown in FIGS. 2A, 2B, and 6 for example, the massage device 1 comprises a pair of left and right kneading massage members 2L and 2R, and a kneading drive section 6 for imparting massage action to the left and right kneading massage members 2L and 2R. In addition, the massage device 1 includes a grabbing massage member 8 having a grabbing massager 7 at its front end, which is disposed on the base end side (or at an intermediate part) of the kneading massage member 2. The massage device 1 is characterized by performing a grabbing massage by moving the grabbing massager 7 of the grabbing massage member 8 close to and away from a kneading massager 9.

In what follows, out of constituent members of the massage device 1, a system for performing a kneading massage, namely the kneading massage member 2 and the kneading drive section 6 for driving the kneading massage member 2 will be described first.

Figure 3A:
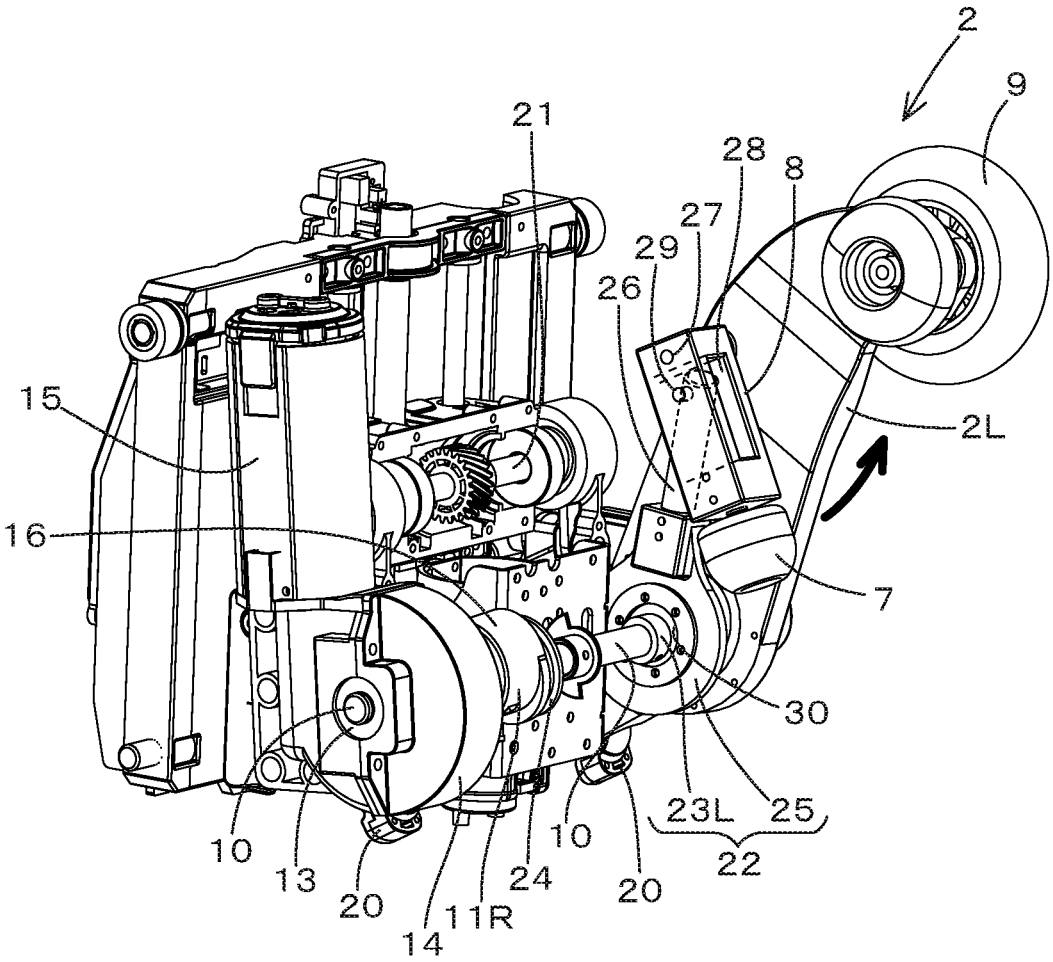
FIG. 3A is a perspective view showing the arrangement of the grabbing massage member in a separated state in the first embodiment.
Figure 3B:
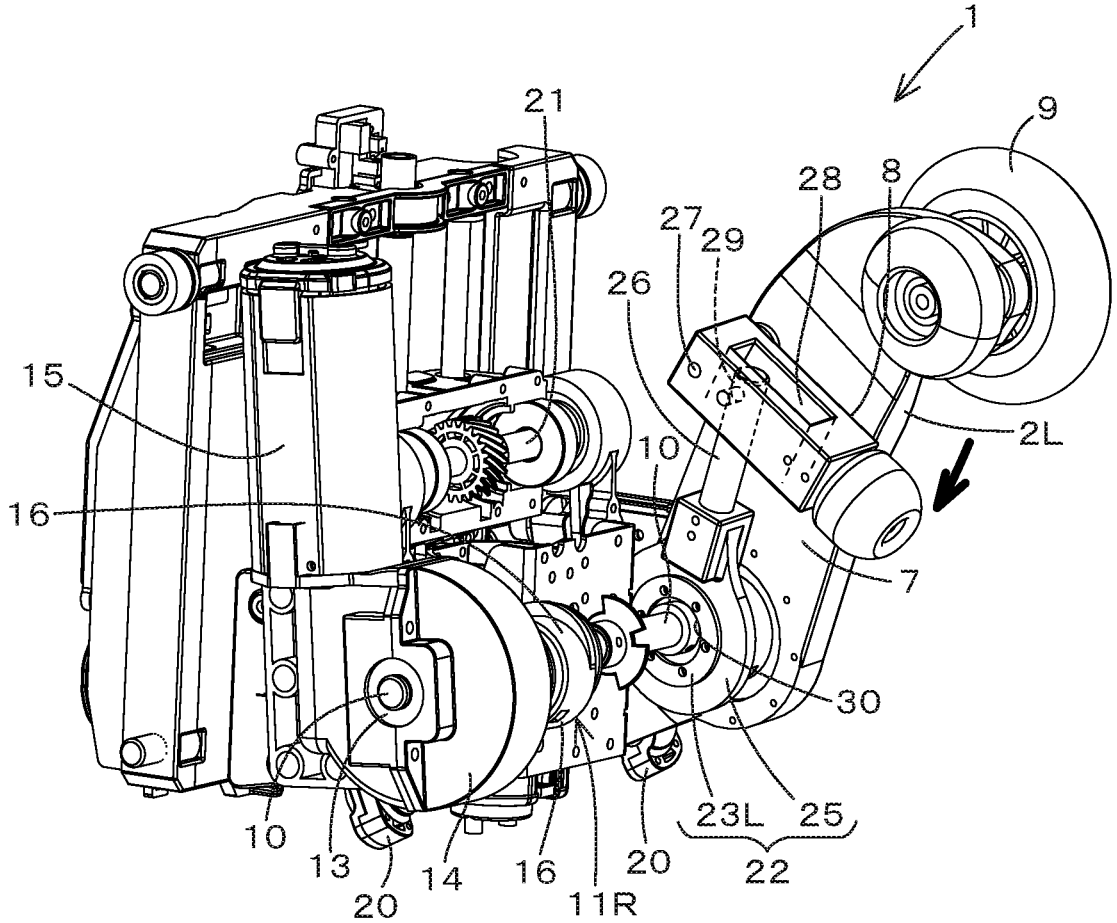
FIG. 3B is a perspective view showing the arrangement of the grabbing massage member in an approaching state in the first embodiment.

As shown in FIGS. 3A and 3B for example, the kneading massage member 2 is a long platy member extending forward and upward at a slight outward incline from the lower side of the front of the massage device 1. Specifically, the kneading massage member 2 is so shaped that its width in the front-rear direction becomes narrower gradually from the lower end to the upper end as seen in a side view. Moreover, the kneading massage member 2 is attached to each of the right side and the left side of the massage device 1, thereby constituting a pair of left and right kneading massage members.

The base end side of the kneading massage member 2, which is coupled to a rotation shaft 10 mounted at the lower side of the front of the massage device 1 so as to point in the horizontal direction, is able to rock under a rotative driving force of the rotation shaft 10 taken out by the kneading drive section 6 as will hereafter be described.

The kneading massager 9, which is attached to the front end of the kneading massage member 2 for abutment against user's back, is made of, for example, hard rubber or synthetic resin in thick-walled discotic or spherical form. Although this embodiment exemplifies a construction in which a single kneading massager 9 is attached to each of the paired left and right kneading massage members 2L and 2R, in the massage device 1 pursuant to the present invention, the kneading massager 9 number is not limited to one. For example, it is possible to adopt a construction in which two kneading massagers 9 (for example, an upper kneading massager and a lower kneading massager) are attached to each of the paired left and right kneading massage members 2L and 2R.

Moreover, in this embodiment, the kneading massager 9 is so designed as to be located at each side of the front end of the kneading massage member in the width direction. The widthwise inner kneading massager 9 is smaller in diameter than the widthwise outer kneading massager 9, and, by moving the grabbing massager 7 close to and away from the small-diameter kneading massager 9, the to-be-massaged area can be subjected to a grabbing massage while being grabbed between the massagers 9 and 7 (the details will be given later).

The kneading drive section 6 for imparting massage action to the left and right kneading massage members 2L and 2R as above described is intended to rock each of the kneading massage members 2L and 2R in the horizontal direction, the front-rear direction, and the vertical direction under the produced rotative driving force of the rotation shaft 10 as above described. Specifically, the kneading drive section 6 comprises: a cylindrical kneading boss portion 11 eccentrically attached to the rotation shaft 10 whose axis points in the horizontal direction; and a kneading engagement portion 12 engaged with the outer peripheral surface of the kneading boss portion 11, for taking out a rotative driving force.

Next, the kneading boss portion 11 and the kneading engagement portion 12 constituting the kneading drive section 6, and also the rotation shaft 10 which transmits (supplies) a rotative driving force to the kneading drive section 6 will be described.

The above-described rotation shaft 10 which supplies a rotative driving force to the kneading drive section 6 is mounted so as to point in the horizontal direction, and both ends of the rotation shaft are each rotatably supported by a bearing tool 13. Moreover, a drive gear 14 for transmitting a rotative driving force to the rotation shaft 10 is attached to an intermediate part of the rotation shaft 10 located toward the right-side bearing tool 13, and, a rotative driving force of a kneading drive motor 15 is transmitted to the drive gear 14.

The kneading drive section 6 comprises the kneading engagement portion 12 embedded in the base end side of the kneading massage member 2L, 2R, and the kneading boss portion 11 fitted within the kneading engagement portion 12.

The kneading engagement portion 12 is a member in the form of a cylinder fixedly attached to the base end side of the kneading massage member 2. The kneading engagement portion 12 is disposed, with its axis pointing in a direction slightly inclined with respect to the horizontal direction, and, the kneading boss portion 11 which will hereafter be described is rotatably fitted within the kneading engagement portion 12.

The kneading boss portion 11 is a cylindrical member which can be inserted into the above-described kneading engagement portion 12, and, like the kneading engagement portion 12, the kneading boss portion 11 is disposed so that its axis points in a direction slightly inclined with respect to the horizontal direction. The kneading boss portion 11 is made to have an outer diameter which is substantially equal to the inner diameter of the kneading engagement portion 12, and is made insertable into the kneading engagement portion 12.

Specifically, the outer peripheral surface of the kneading boss portion 11 is formed with an inclined cam face 16 inclined with respect to the axis of the rotation shaft 10, and, the kneading engagement portion 12 is slidably engaged with the inclined cam face 16. That is, the inclined cam face 16 is so disposed as to go around an axis pointing in a direction inclined with respect to the axis of the rotation shaft 10, for guiding the kneading engagement portion 12 in movement along a go-around trackway which is eccentric with respect to the axis of the rotation shaft 10. Therefore, as the rotation shaft 10 is rotated, the kneading engagement portion 12 is moved around an axis inclined with respect to the axis of the rotation shaft 10.

The kneading engagement portion 12 is provided with a swing restraining mechanism 17 for restraining the kneading engagement portion 12 from rotating together with the kneading boss portion 11, in other words, for restraining the kneading massage member 2L, 2R from rotating together with the rotation shaft 10. A force in the direction of rotation can be converted into a force in the direction of translation by the swing restraining mechanism 17.

Figure 4:
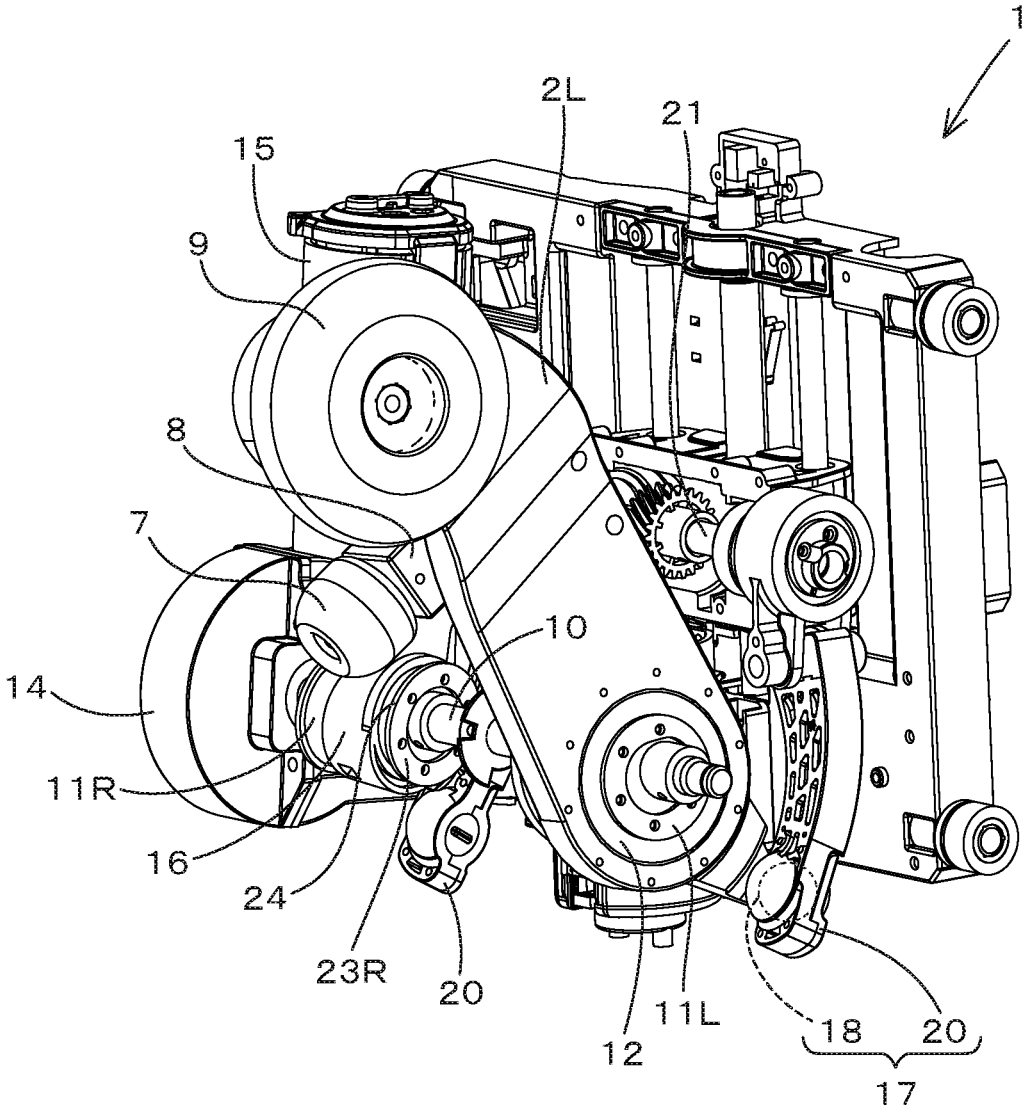
FIG. 4 is a drawing showing an eccentricity of the kneading boss portion in the massage device of the first embodiment.

As shown in FIG. 4, the swing restraining mechanism 17 is designed to restrain the kneading engagement portion 12 against co-rotation with the kneading boss portion 11 by means of rockable coupling of the base end side of the kneading massage member 2L, 2R to the main body of the massage device 1 (to be specific, a tapping drive shaft 21 which will hereafter be described).

Specifically, the swing restraining mechanism 17 comprises: a universal joint portion 18 (ball joint) formed at the base end side of the kneading massage member 2; and a crank arm 20 having, at its forward end, a hole 19 in which is fitted the universal joint portion 18. The rear end side of the crank arm 20 is coupled to the tapping drive shaft 21. As for this structure, it is desirable to adopt the technology that has already been applied by the applicant of the present application (Japanese Unexamined Patent Publication JP-A 2012-280520).

In such a swing restraining mechanism 17, since the crank arm 20 is externally fitted to a lateral side of the universal joint portion 18 protruding sideward from the kneading massage member 2L, 2R, it is possible to minimize interference between the crank arm 20 and the base end side of the kneading massage member 2L, 2R. This helps widen the range of motion of the kneading massage member 2 (the amount of jutting action thereof in the front-rear direction).

In the above-described kneading massage member 2L, 2R, as the rotation shaft 10 is driven to rotate by the kneading drive motor 15, the kneading boss portion 11 secured to the rotation shaft 10 is rotated correspondingly about an axis pointing in the horizontal direction, viz., horizontally-directed axis. However, the inclined cam face 16 formed on the outer peripheral surface of the kneading boss portion 11 is, due to the trackway such as to go around an axis inclined with respect to the horizontally-directed axis, rotated about the axis of the rotation shaft 10 while swinging in the horizontal direction. Correspondingly, the kneading engagement portion 12 engaged with the inclined cam face 16 undergoes such a swinging motion in the horizontal direction, with the consequence that the horizontal swinging motion is transmitted to the kneading massage member 2L, 2R fitted with the kneading engagement portion 12.

By virtue of the action of the swing restraining mechanism 17 as above described, even if the rotation shaft 10 is rotated about a horizontally-directed axis, it never occurs that the kneading massage member 2L, 2R is rotated together with the rotation shaft 10. Thus, the kneading massage member 2L, 2R is rocked while being allowed to move along the front-rear direction, the horizontal direction, and the vertical direction only within a predetermined range of motion.

As thus far described, the paired left and right kneading massage members 2L and 2R are designed so that their kneading massagers 9 are moved close to and away from each other. It is thus difficult for the above-described massage mechanism in an as-is state to achieve a so-called "shoulder grabbing massage" based on user's request.

In this regard, the massage device 1 pursuant to the present invention is provided with the grabbing massage member 8 which performs a grabbing massage on a to-be-massaged area by moving the grabbing massager 7 close to and away from the kneading massager 9 of the kneading massage member 2 so that the to-be-massaged area is grabbed between the massagers 9 and 7.

Specifically, the massage device 1 of the first embodiment has the grabbing massage member 8 which is disposed on the base end side of the kneading massage member 2, and has the grabbing massager 7 at its front end. The grabbing massage member 8 is designed to move the grabbing massager 7 close to and away from the kneading massager 9 by exploiting the earlier described rotative driving force of the rotation shaft 10, and, a grabbing drive section 22 for imparting approaching and separating motion to the grabbing massage member 8 is disposed in the massage device 1 of the first embodiment.

Moreover, the grabbing drive section 22 comprises: a grabbing boss portion 23 having a cam face 24 formed on its outer peripheral surface, which is eccentrically attached to the rotation shaft 10; an annular engagement portion 25 engaged with the cam face 24 of the grabbing boss portion 23, for taking out a rotative driving force; and a crank member 26 having its base end connected to the annular engagement portion 25, and has its front end connected to the grabbing massage member 8, for transmitting the produced rotative driving force to the grabbing massage member 8.

Moreover, in the grabbing massage member 8, the base end is pivotally supported on the kneading massage member 2 for free rotation about a horizontal axis relative to the front end fitted with the grabbing massager 7. Furthermore, the front end of the crank member 26 is coupled to an intermediate part of the grabbing massage member 8 in the direction of its length for free rotation about a horizontally-directed axis. In this construction, upon movement of the crank member 26 in its extending direction, the grabbing massage member 8 is rocked back and forth.

Next, the grabbing massage member 8, as well as the grabbing boss portion 23, the annular engagement portion 25, and the crank member 26 constituting the grabbing drive section 22, provided in the massage device 1 pursuant to the present invention will be described.

As shown in FIGS. 3A and 3B, the grabbing massage member 8 is a long rodlike member having the grabbing massager 7 at its one end (front end). The grabbing massager 7 is assigned to each of the left and right kneading massage members 2L and 2R, and, in this embodiment, a single grabbing massager is mounted on each of the right and left sides of the device. Like the kneading massager 9, for example, the grabbing massager 7 is made of hard rubber or synthetic resin in thick-walled discotic or spherical form, with consideration given to prevention of injury caused by the action of grabbing user's to-be-massaged area between the massagers 7 and 9.

Moreover, the other end (base end) of the grabbing massage member 8 is fitted with a pivot pin 27 for supporting the grabbing massage member 8 for free rocking motion relative to the kneading massage member. The pivot pin 27 is located on the base end (rear end) side of the kneading massage member in the direction of its length, for supporting one end of the grabbing massage member 8 for free rotation about a horizontally-directed axis relative to the other end thereof.

Moreover, a long hole in slit form, namely a slot 28 is formed in a lengthwise intermediate part of the grabbing massage member 8. The slot 28 is so formed as to extend along the direction of the length of the above-described grabbing massage member 8, as to open into each of the upper surface and lower surface of the grabbing massage member 8, and as to pass through the interior of the grabbing massage member 8 in the vertical direction. Furthermore, the slot 28 is made to have a width which is greater than the outer diameter of the front end side of the crank member 26 (the details will be given later), so that the front end side of the crank member 26 can be freely inserted into and withdrawn from the slot. In addition, inside the slot 28, a coupling pin 29 for permitting connection with the front end of the crank member 26 is placed in a position near the above-described pivot pin 27 (the other end). The coupling pin 29 is mounted so as to point in the horizontal direction, for coupling the front end of the crank member 26 to the grabbing massage member 8 for free rotation about a horizontally-directed axis.

On the other hand, the grabbing boss portion 23 constituting the grabbing drive section 22 is attached to the rotation shaft 10 for imparting a rotative driving force to the above-described kneading massage member 2 (identical rotation shaft 10).

The grabbing boss portion 23 is a discotic member disposed inwardly of the above-described kneading boss portion 11L, 11R of the rotation shaft 10 in the width direction. The left-side grabbing boss portion 23L is situated on the right side of the left-side kneading boss portion 11L, whereas the right-side grabbing boss portion 23R is situated on the left side of the right-side kneading boss portion 11R.

Like the kneading boss portion 11, the grabbing boss portion 23 is also eccentrically attached to the rotation shaft 10. Specifically, as shown in FIG. 4, in a case where the kneading boss portion 11 is decentered rearwardly and upwardly from the center of the base end side of the kneading massage member 2L, 2R, as shown in FIG. 3B, the grabbing boss portion 23 is decentered rearwardly and downwardly from the center of the base end side of the kneading massage member 2L, 2R. That is, the kneading boss portion 11 and the grabbing boss portion 23 are decentered in different directions so as to cause an angular difference of about 90 degrees between their eccentric directions.

Moreover, the outer peripheral surface of the grabbing boss portion 23 is also formed with the cam face 24. The cam face 24 is formed along a cylindrical trackway such as to go around an axis pointing in a direction inclined with respect to the axis of the rotation shaft 10, for guiding the annular engagement portion 25 which will hereafter be described in movement along the go-around trackway which is eccentric with respect to the rotation shaft 10.

The direction of inclination of the cam face 24 with respect to the axis of the rotation shaft 10 is the same as the direction of inclination of the above-described inclined cam face 16 with respect to the axis of the rotation shaft 10. Therefore, the cam face 24 and the inclined cam face 16 are arranged so as to go around the axes that are parallel to each other and point in the same direction, respectively. That is, the crank member 26 of the annular engagement portion 25 to be guided along the cam face 24 and the kneading massage member 2 with the kneading engagement portion 12 to be guided along the inclined cam face 16 are equal in inclination direction at all times, wherefore it never occurs that these members collide with each other during rotatory motion.

The annular engagement portion 25 is a cylindrical member which can be externally fitted to the outer side of the grabbing boss portion 23. The annular engagement portion 25 has a boss insertion hole 30 for insertion of the aforementioned grabbing boss portion 23 formed so as to pass therethrough in the horizontal direction. The grabbing boss portion 23 is fitted in the boss insertion hole 30 so that the cam face 24 of the grabbing boss portion 23 has face-to-face contact with the inner peripheral surface of the boss insertion hole 30, whereby the crank member 26 is guided along the go-around trackway which is eccentric with respect to the rotation shaft 10.

The crank member 26 is a rodlike member extending radially outwardly from the outer peripheral surface of the above-described annular engagement portion 25 (extending in a direction longitudinally of the kneading massage member 2). The base end side of the crank member 26 is secured to the outer peripheral side of the annular engagement portion 25, and, the front end side of the crank member 26 is pivotally supported on the coupling pin 29 of the grabbing massage member 8 for free rotation about a horizontally-directed axis.

Methods for performing a grabbing massage on a body area to be massaged with use of the massage device 1 as described hereinabove, in other words, modes for driving the grabbing massage member 8 pursuant to the present invention will be described.

As has already been described, upon rotation of the rotation shaft 10 effected by the kneading drive motor 15, the kneading massage member 2L, 2R is rocked in the horizontal direction, whereby a grabbing massage is performed on the to-be-massaged area.

In addition to the resultant kneading action, as the rotation shaft 10 is further rotated, the grabbing boss portion 23 disposed inwardly of the kneading boss portion 11 of the rotation shaft 10 in the horizontal direction (width direction) is rotated correspondingly. This grabbing boss portion 23 has a discotic shape, and, as has already been described, the rotation shaft 10 passes through an eccentric position of the grabbing boss portion 23 offset from the center of the discotic shape. Therefore, upon rotation of the rotation shaft 10, the grabbing boss portion 23 is rotated eccentrically about the axis of the rotation shaft 10.

However, the front end side of the crank member 26 externally fitted to the above-described grabbing boss portion 23 is pivotally supported on the coupling pin 29 of the grabbing massage member 8, and, the grabbing massage member 8 is coupled to the kneading massage member 2 via the pivot pin 27. Therefore, the front end side of the crank member 26, while being able to rock about a horizontally-directed axis to a certain extent at a pivotal point defined by the pivot pin 27, is restrained against rotation about the axis of the rotation shaft 10 together with the grabbing boss portion 23. In consequence, in the crank member 26 externally fitted to the grabbing boss portion 23, the distance from the axis of the rotation shaft 10 to the front end of the crank member 26 varies endways, and, in response to the rotation of the rotation shaft 10, the crank member 26 moves forward and upward as part of advancing and retracting motion.

Figure 5A:
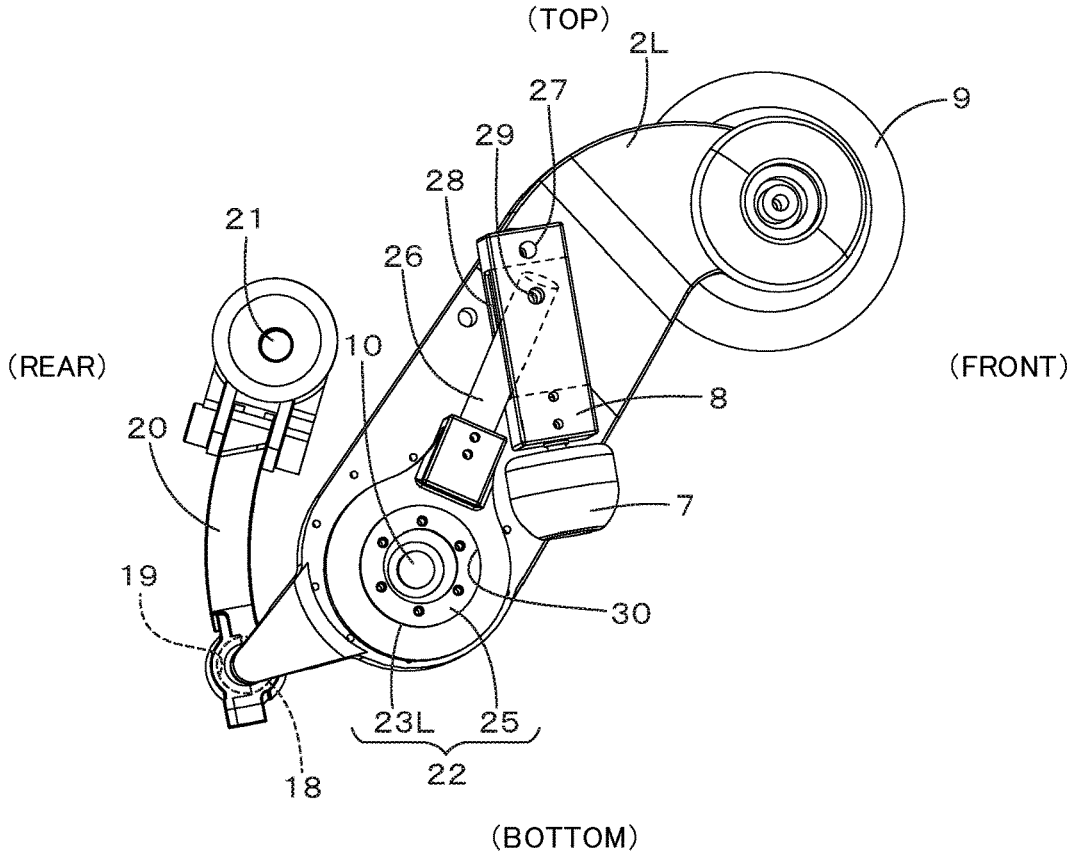
FIG. 5A is a drawing showing the grabbing massage member under separating movement in the first embodiment as seen in side view.

For example, as shown in FIG. 5A, when the rotation shaft 10 and the grabbing boss portion 23 in eccentric relation are rotated together with the consequence that the crank member 26 moves backward and downward for retraction, the crank member 26 is pulled down, and the location of the coupling pin 29 is shifted downward correspondingly, whereupon the grabbing massage member 8 is rocked downward about the pivot pin 27. Then, in response to the downward rocking motion of the grabbing massage member 8, the grabbing massager 7 attached to the front end of the grabbing massage member 8 moves away from the kneading massager 9.

Figure 5B:
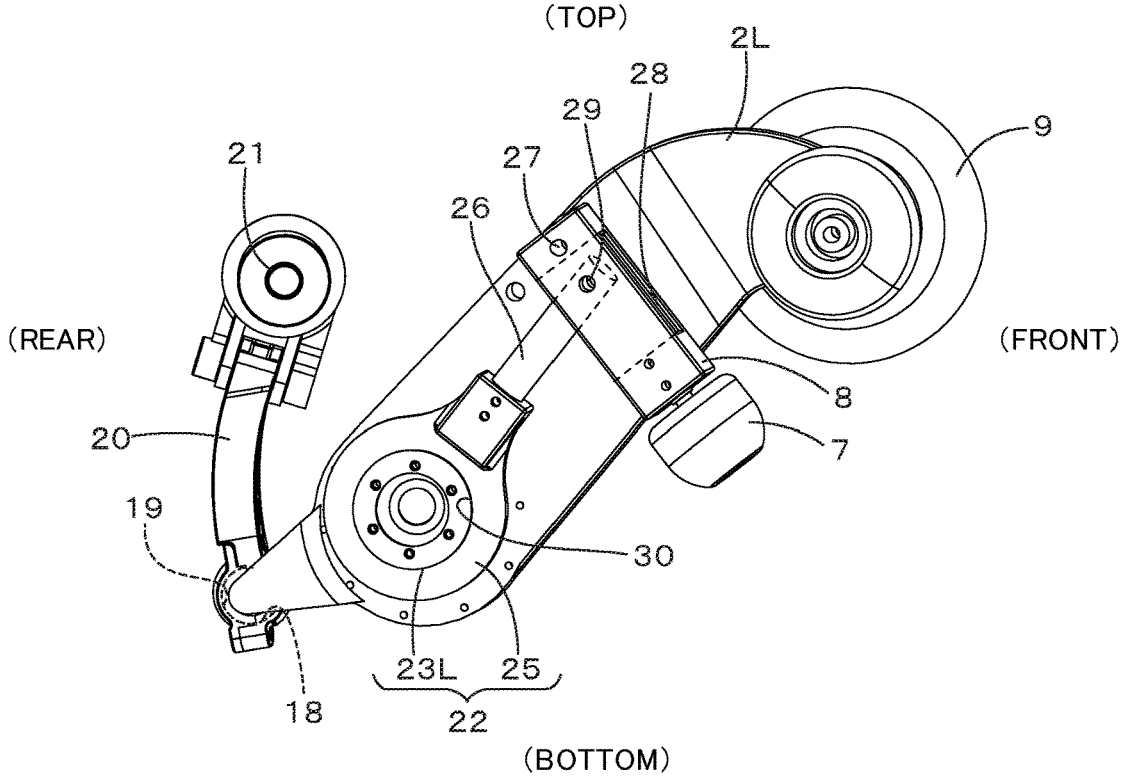
FIG. 5B is a drawing showing the grabbing massage member under approaching movement in the first embodiment as seen in side view.

In contrast, as shown in FIG. 5B, when the grabbing boss portion 23 is further rotated with the consequence that the crank member 26 moves forward and upward for advancement, the crank member 26 is pushed up, and the location of the coupling pin 29 is shifted upward correspondingly, whereupon the grabbing massage member 8 is rocked upward about the pivot pin 27. Then, in response to the upward rocking motion of the grabbing massage member 8, the grabbing massager 7 attached to the front end of the grabbing massage member 8 moves close to the kneading massager 9.

That is, in the massage device 1 of the first embodiment, in response to the rotation of the rotation shaft 10, the grabbing massager 7 is moved away from and close to the kneading massager 9 repeatedly. Thus, by positioning the massage device 1 so that a to-be-massaged area is located between the grabbing massager 7 and the kneading massager 9, it is possible to achieve the "to-be-massaged area (shoulder, for example) grabbing massage".

Second Embodiment

Next, a massage device 1 implemented as the second embodiment will be described.

As shown in FIGS. 7A to 9B, the massage device 1 of the second embodiment is provided with a grabbing drive section 22 which differs from the grabbing drive section 22 of the first embodiment.

Specifically, as is the case with the first embodiment, the grabbing drive section 22 of the second embodiment comprises a grabbing boss portion 23 and an annular engagement portion 25. The grabbing drive section 22 of the second embodiment differs from the grabbing drive section of the first embodiment in that the grabbing massager 7 is moved close to and away from the kneading massager 9 through insertion of a guide pin 31 disposed in protrusion form in the kneading massage member 2 into a guide groove 32 provided in the grabbing massage member 8.

Next, the guide pin 31 and the grabbing massage member 8 constituting the massage device 1 of the second embodiment will be described.

The above-described kneading massage member 2 has, at its side surface, the guide pin 31 protruding toward the grabbing massage member 8. The guide pin 31 is, in the left-side kneading massage member 2L, formed so as to protrude rightward from the right side surface of the kneading massage member (protrude inward in the width direction), whereas, in the right-side kneading massage member 2R, the guide pin 31 is formed so as to protrude leftward from the left side surface of the kneading massage member (protrude inward in the width direction).

Moreover, two guide pins 31 are formed in each of the kneading massage members 2, and, one guide pin 31 lying farther away from the rotation shaft 10 is located slightly frontward beyond the other guide pin 31 lying closer to the rotation shaft 10. In the case of using such two guide pins 31, the kneading massager 9 is located on a line connecting these two guide pins 31, wherefore the grabbing massager 7 can be rectilinearly moved close to and away from the kneading massager 9. These guide pins 31 are each made to have an outer diameter which is smaller than the grove width of the aforementioned guide groove 32 so as to be able to move freely within the guide groove 32 of the grabbing massage member 8.

The grabbing massage member 8 comprises: a guide member 33 having the above-described guide groove 32 capable of guiding the guide pin 31; and a grabbing massager 7 formed at the lower edge of the guide member 33. Specifically, the guide member 33 is a slim strip-like platy member, and, the guide groove 32 is formed in a widthwise midportion of the guide member 33 so as to extend along the direction of its length. The guide member 33 is supported for free rotation about a rotary shaft 34 located at a lengthwise intermediate part of the kneading massage member 2L, 2R, so that the lower end side of the guide member 33 can be rotated about a horizontally-directed axis relative to the upper end side thereof fitted with the rotary shaft 34.

The guide groove 32 is a slit-like groove part in which both of the above-described two guide pins 31 can be inserted, and, the insertion of the two guide pins 31 in it allows the guide member 33 to move rectilinearly relative to the grabbing massage member 8. Moreover, the length of the guide groove 32 is determined on the basis of the length of the spacing between the two guide pins 31 as a reference length, and, the guide groove 32 is formed centrally of the guide member 33 so as to have a length about twice the reference length. In the massage device 1 of the second embodiment, as the guide pin 31 is moved between the upper edge and the lower edge of the guide groove 32, the guide member 33 is moved along the extending direction of the kneading massage member 2, thereby performing a grabbing massage.

Figure 8A:
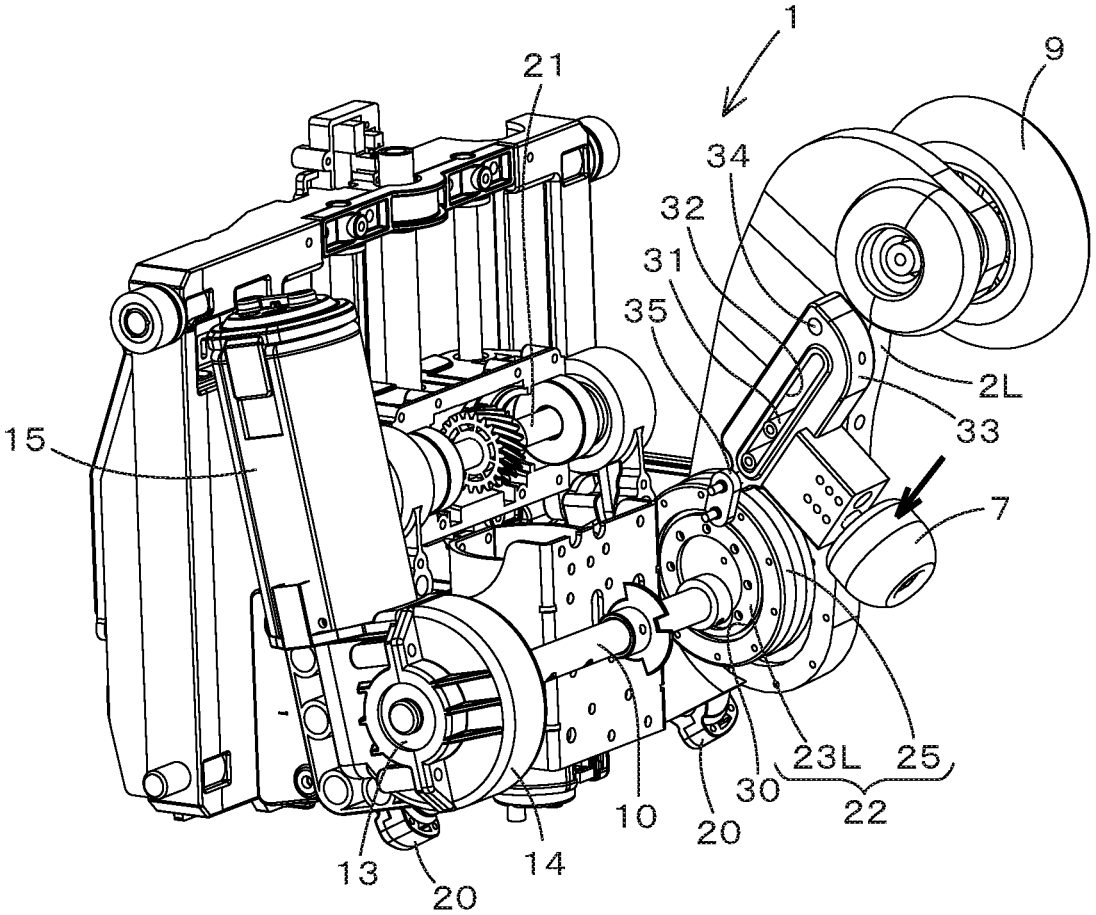
FIG. 8A is a perspective view showing the arrangement of the grabbing massage member in an approaching state in the second embodiment.
Figure 8B:
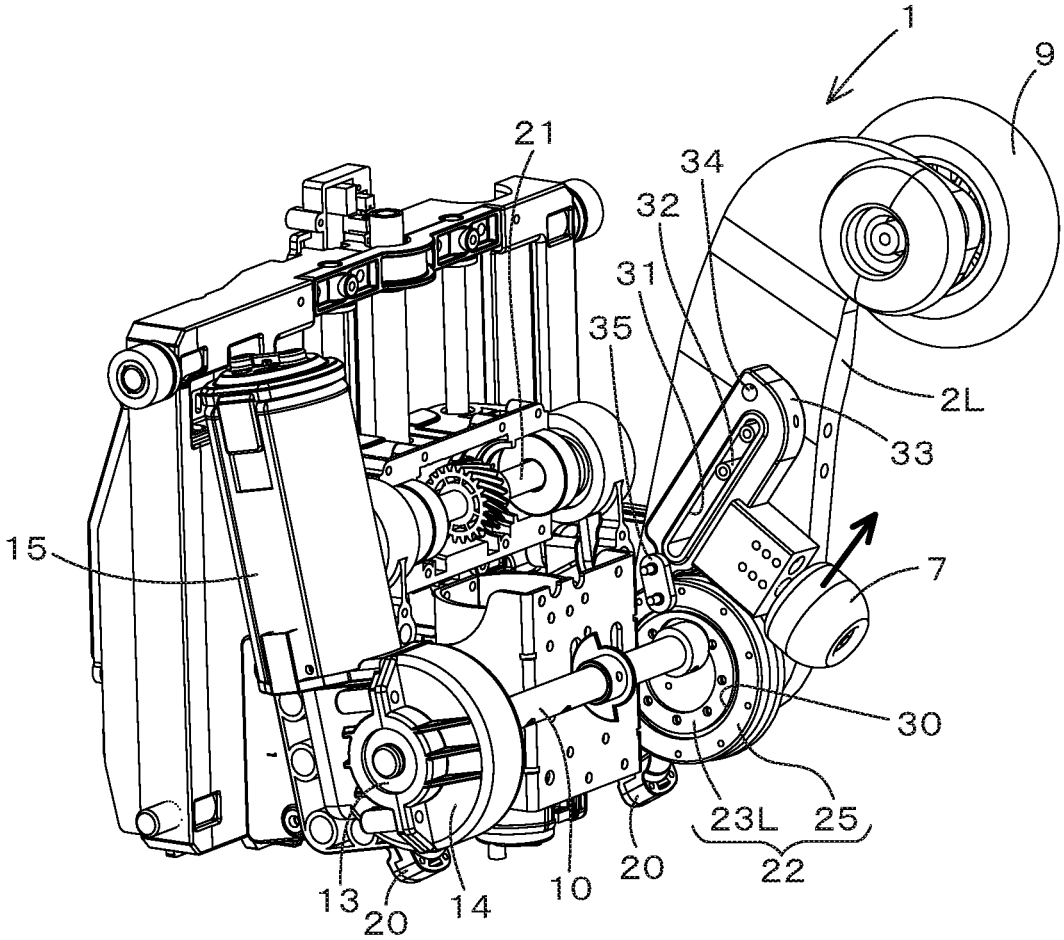
FIG. 8B is a perspective view showing the arrangement of the grabbing massage member in a separated state in the second embodiment.

For example, as shown in FIG. 8B, when the upper one of the two guide pins 31 abuts on the upper edge of the guide groove 32, then the distance between the grabbing massager 7 and the kneading massager 9 becomes maximum. On the other hand, as shown in FIG. 8A, when the lower one of the two guide pins 31 abuts on the lower edge of the guide groove 32, then the distance between the grabbing massager 7 and the kneading massager 9 becomes minimum.

It is noted that, in contrast to the above-described structure, alternatively, the guide pin 31 may be formed in the grabbing massage member 8, and the guide groove 32, in which the guide pin 31 is slidably moved, may be formed in the kneading massage member 2.

A coupling member 35 is disposed between the lower end side of the above-described grabbing massage member 8 and the outer peripheral side of the annular engagement portion 25 in order to provide connection between the grabbing massage member 8 and the annular engagement portion 25. The coupling member 35 is a long platy member, the lengthwise base end of which is connected for free rotation about a horizontal axis relatively to the annular engagement portion 25. Moreover, the lengthwise front end of the coupling member 35 is connected for free rotation about a horizontal axis relatively to the base end of the grabbing massage member 8. That is, in this construction, the grabbing massage member 8 is coupled relatively to the annular engagement portion 25 so that the distance between these two members can be varied.

Figure 9A:
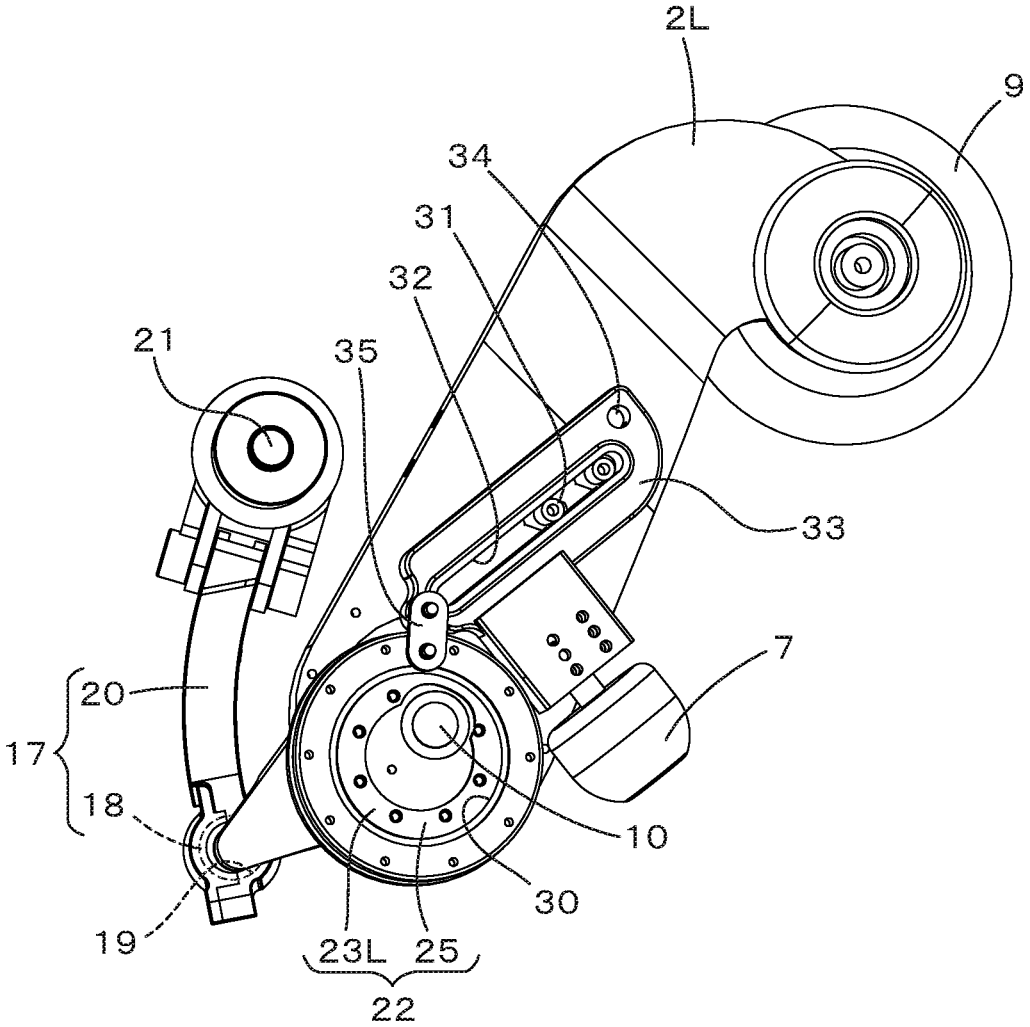
FIG. 9A is a drawing showing the grabbing massage member under separating movement in the second embodiment as seen in side view.

Also in the massage device 1 of the second embodiment thus far described, as shown in FIG. 9A, when the rotation shaft 10 and the grabbing boss portion 23 in eccentric relation are rotated together with the consequence that the part of the grabbing boss portion 23 protruding eccentrically with respect to the rotation shaft 10 faces rearward and downward, the guide member 33 is allowed to slide rearward and downward via the coupling member 35 for retraction, whereupon the grabbing massager 7 moves away from the kneading massager 9.

Figure 9B:
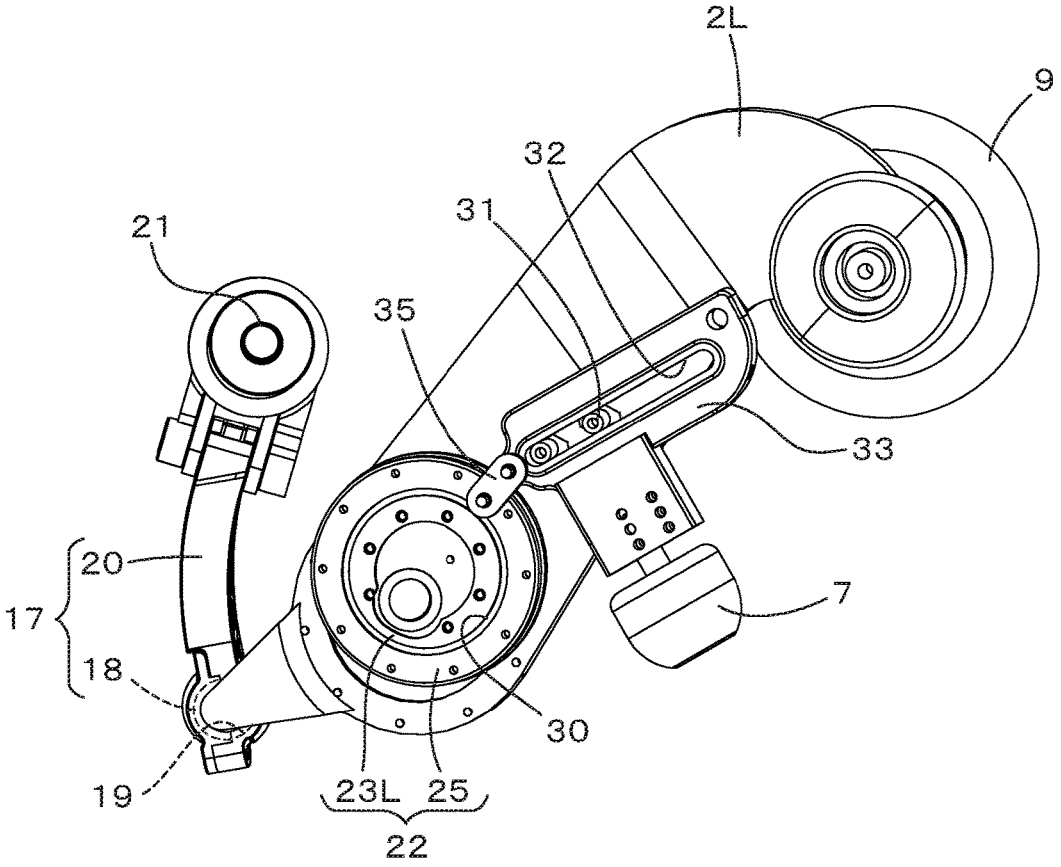
FIG. 9B is a drawing showing the grabbing massage member under approaching movement in the second embodiment as seen in side view.

In contrast, as shown in FIG. 9B, when the rotation shaft 10 and the grabbing boss portion 23 in eccentric relation are rotated together with the consequence that the part of the grabbing boss portion 23 protruding eccentrically with respect to the rotation shaft 10 faces forward and upward, the guide member 33 is allowed to slide forward and upward via the coupling member 35 for advancement, whereupon the grabbing massager 7 moves close to the kneading massager 9.

That is, also in the massage device 1 of the second embodiment, in response to the rotation of the rotation shaft 10, the grabbing massager 7 is moved away from and close to the kneading massager 9 repeatedly. Thus, by positioning the massage device 1 so that a to-be-massaged area is located between the grabbing massager 7 and the kneading massager 9, it is possible to achieve the "to-be-massaged area (shoulder, for example) grabbing massage".

As described heretofore, according to the massage device 1 pursuant to the present invention, a grabbing massage can be performed on an area to be massaged by grabbing the area between the kneading massage member 2 and the grabbing massage member 8.

Third Embodiment

Next, a massage device 1 implemented as the third embodiment will be described.

As shown in FIGS. 10A to 13B, like the first embodiment, the massage device 1 of the third embodiment comprises a grabbing massage member 8 capable of performing a grabbing massage on user's to-be-massaged area.

The massage device 1 of the third embodiment differs from that of the first embodiment in respect of the mounting position of the grabbing massage member 8 (a position for mounting the grabbing massage member 8 relative to the kneading massage member 2). That is, as shown in FIGS. 5A and 5B for example, in the massage device 1 of the first embodiment, the base end side of the grabbing massage member 8 is pivotally supported, via the pivot pin 27, on an intermediate part of the kneading massage member 2L, 2R extending radially outwardly from the rotation shaft 10. Expressed differently, in the massage device 1 of the first embodiment, when looking from the rotation shaft 10, the kneading massager 9 and the grabbing massager 7 (grabbing massage member 8) are arranged on the same side.

Figure 10A:
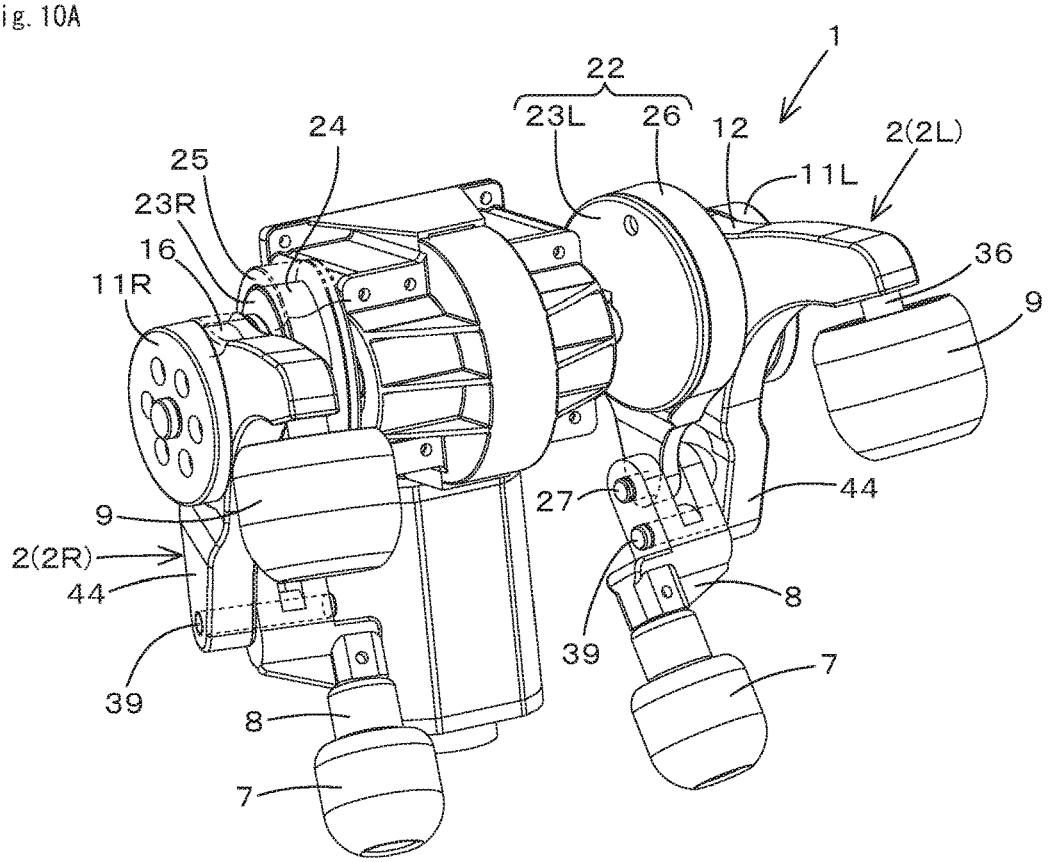
FIG. 10A is a perspective view of the massage device of the third embodiment, with the grabbing massage member located away from the kneading massage member.
Figure 10B:
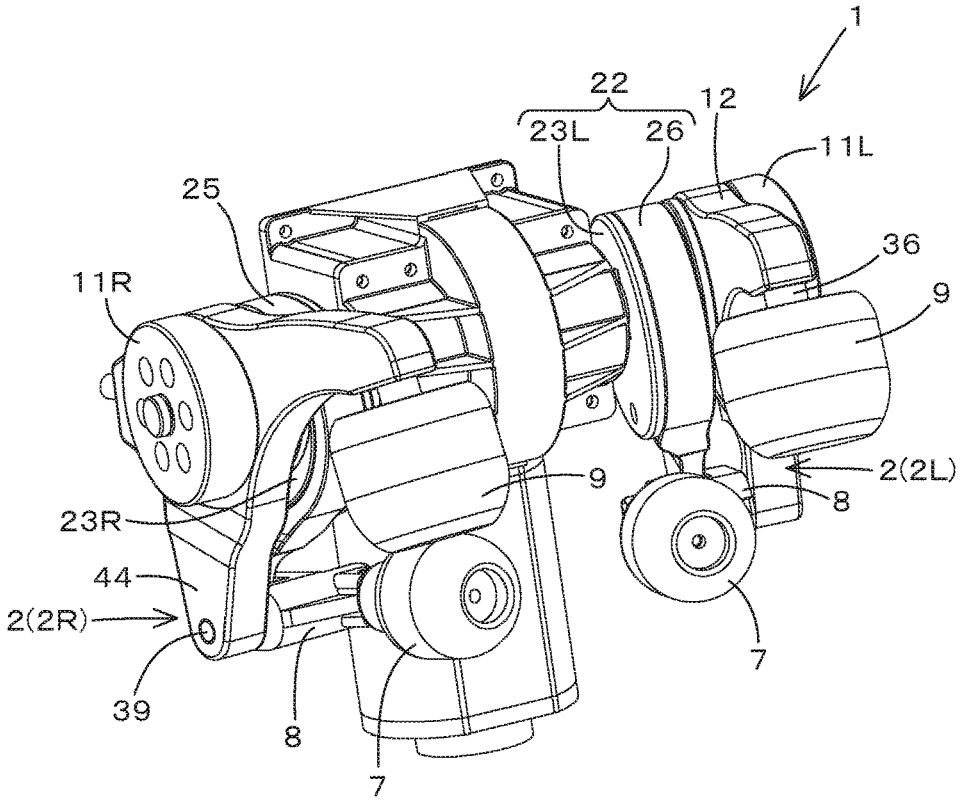
FIG. 10B is a perspective view of the massage device of the third embodiment, with the grabbing massage member located close to the kneading massage member.

On the other hand, in the massage device 1 of the third embodiment, as shown in FIGS. 10A and 10B, the kneading massage member 2 is so formed as to extend both in an upward direction and in a downward direction with reference to the rotation shaft 10, and, the front end of the upwardly-extending part of the kneading massage member 2 (the upper end of the kneading massage member 2) is coupled with the kneading massager 9, whereas the front end of the downwardly-extending part thereof (the lower end of the kneading massage member 2) is coupled with the base end of the grabbing massage member 8. That is, in a construction adopted as the massage device 1 of the third embodiment, when viewed from the rotation shaft 10, the kneading massager 9 and the grabbing massager 7 are arranged on opposite sides in a circumferential direction, and, the kneading massage member 2 is formed with a downwardly-extending protrusion 44 whose front end is coupled with the grabbing massage member 8.

In such a massage device 1 of the third embodiment, since the kneading massager 9 and the grabbing massager 7 are vertically spaced apart as upper and lower members, respectively, with the axis of the rotation shaft 10 located between them, in order to move the grabbing massager 7 close to and away from the kneading massager 9, it is inevitable to increase the rocking distance of the grabbing massager 7. That is, in the massage device 1 of the third embodiment, when the grabbing massager 7 is moved close to and away from the kneading massager 9, it is possible to secure a wider range of rocking motion of the grabbing massage member 8 in the vertical direction, and thereby achieve even stronger massage on a target body area to be massaged.

Next, the kneading massage member 2, the grabbing massage member 8, and the grabbing drive section 22 constituting the massage device 1 of the third embodiment will be described.

As shown in FIGS. 10A and 10B, the kneading massage member 2 is a long platy member mounted on each of the right and left sides of the massage device 1, which is capable of performing a kneading massage on user's to-be-massaged area with use of the kneading massager 9 disposed at its front end.

The kneading massage member 2 is disposed adjacent the horizontal outer side of the grabbing massage member 8 having the grabbing massager 7, and more specifically there is provided a pair of left and light kneading massage members 2L and 2R. The left kneading massage member 2L and the right kneading massage member 2R are arranged in bilaterally line-symmetric relation to each other.

Each of the kneading massage members 2L and 2R is shaped like a long and thin strip plate bent into a substantially L-shaped form when viewed from the side in the horizontal direction, and, a kneading boss portion 11L, 11R is disposed in a lengthwise intermediate part of the substantially right-angled bend. Specifically, the kneading massage member 2L, 2R has, in its lengthwise intermediate part, an engagement hole capable of receiving the cylindrical kneading boss portion 11L, 11R, and, the kneading boss portion 11L, 11R is fitted in this engagement hole, with its axis pointing in the horizontal direction. The kneading boss portion 11L, 11R and the kneading massage member 2L, 2R are designed for free mutual rotation.

The above-described kneading massage member 2L, 2R has a restraint projection 42 formed so as to extend outward (toward a casing) from the outer peripheral surface of a lengthwise intermediate part thereof. The front end of the restraint projection 42 is inserted in a guide slot 43 formed at the inner peripheral surface of the casing of the massage device 1, and, the guide slot 43 is formed along the horizontal direction. With the adoption of such a system, upon horizontal movement of the restraint projection 42 within the guide slot 43, the kneading massage member 2L, 2R can be rocked in the horizontal direction while being restrained against movement in the front-rear direction. Thus, as compared with the first and second embodiments, the rocking motion of the kneading massage member 2L, 2R can be accomplished in a simpler structure.

Lengthwise one end (upper end) side of the kneading massage member 2 protrudes forward and upward with respect to the intermediate part formed with the engagement hole, and, the thick-walled kneading massager 9 is disposed at the upper end thereof. Specifically, a forwardly and downwardly extending massager support shaft 36 is disposed at the upper end of the kneading massage member 2, and, the kneading massager 9 is attached to the front end of the massager support shaft 36 for free rotation relative to the massager support shaft 36.

Moreover, lengthwise the other end (lower end) side of the kneading massage member 2 protrudes forward and downward with respect to the intermediate part, and, the lower end thereof is formed with a coupling hole for insertion of a rocking pin 39 for permitting connection with the grabbing massage member 8. Specifically, in the kneading massage member 2, this forwardly and downwardly protruding part serves as the protrusion 44 for coupling the grabbing massage member 8 to the kneading massage member 2, and, the coupling hole is formed in the front end (lower end) of the protrusion 44, so that the base end side of the grabbing massage member 8 can be coupled to the kneading massage member via the rocking pin 39 inserted in the coupling hole. The coupling hole is formed in a position adjacent to the lateral side of a through hole formed in the grabbing massage member 8 so as to pass through a lengthwise intermediate part thereof in the horizontal direction, so that the coupling hole and the through hole can communicate with each other to define an opening. Upon insertion of the rocking pin 39 into both of the coupling hole and the through hole in communicating condition, the grabbing massage member 8 is pivotally supported on the other end of the kneading massage member 2 for free rotation about a horizontally-directed axis, whereby these members can be coupled to each other.

A rotative driving force is transmitted from a drive motor 15 to the above-described rotation shaft 10 through a drive gear. In the third embodiment, the drive motor 15 is disposed centrally of the massage device 1 in the width direction, and, the rotation shaft 10 disposed adjacent the widthwise outer side of the drive gear is equipped with a bearing portion for rotatably supporting the rotation shaft 10. That is, the rotation shaft 10 of the third embodiment is so shaped that each axial end extends outward from the bearing portion in the horizontal direction, and, the above-described kneading boss portion 11L, 11R is supported by that part of the bearing portion which is located outward in the width direction.

Figure 11A:
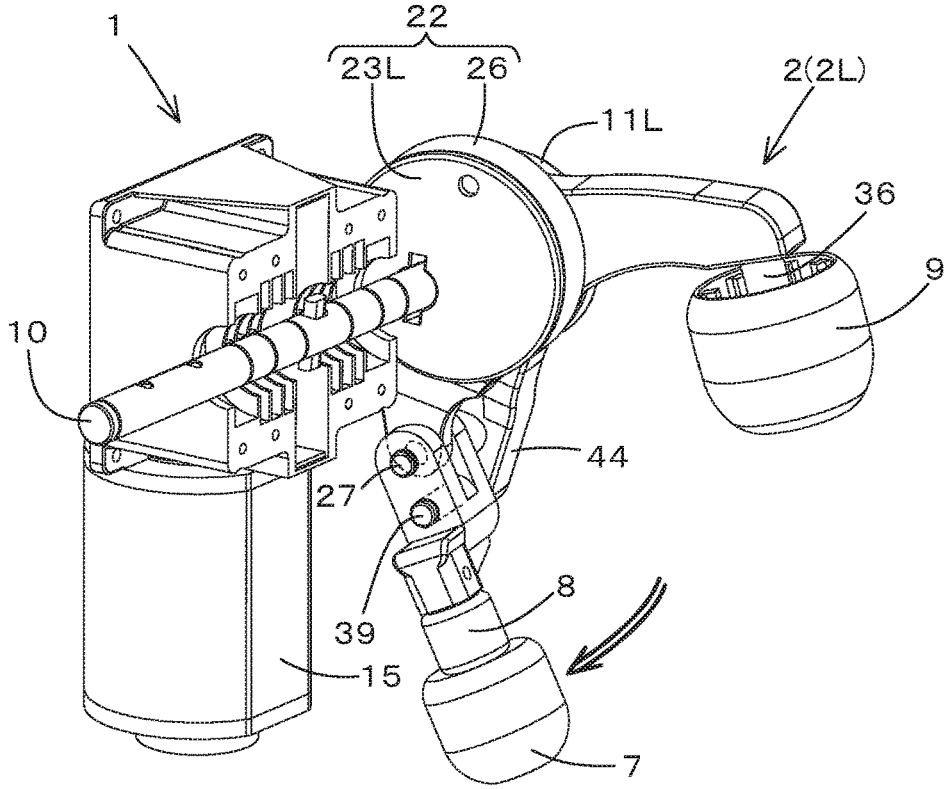
FIG. 11A is a perspective view showing the arrangement of the grabbing massage member in a separated state in the third embodiment.
Figure 11B:
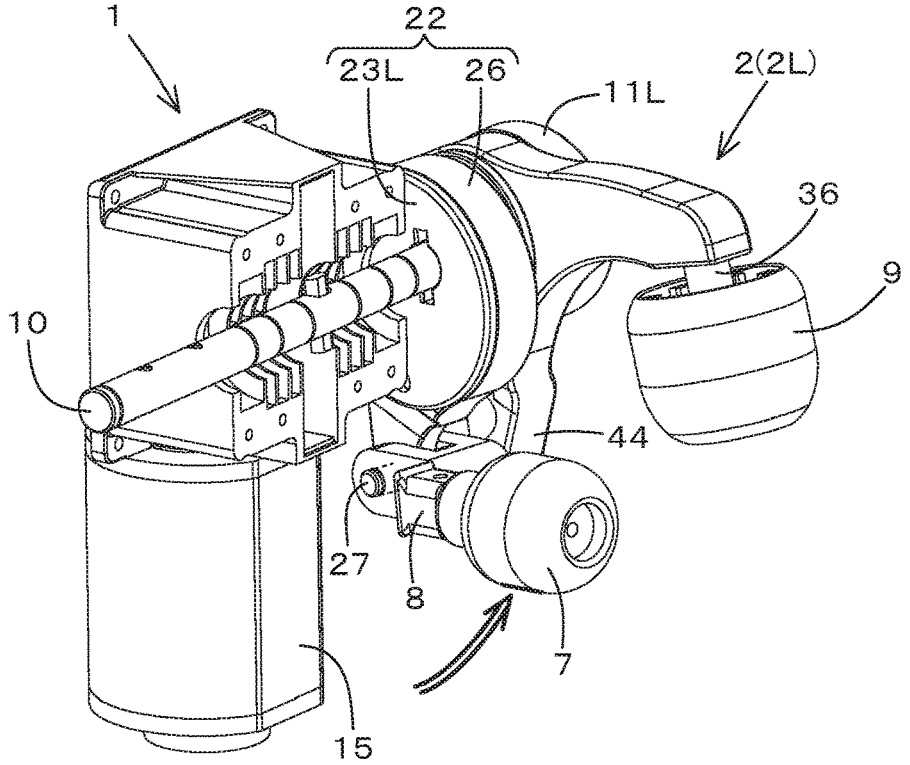
FIG. 11B is a perspective view showing the arrangement of the grabbing massage member in an approaching state in the third embodiment.

As shown in FIGS. 11A and 11B, the grabbing massage member 8 is a long rodlike member which has a lengthwise intermediate part bent to form a step in the horizontal direction. One end side of the grabbing massage member 8 is fitted with the grabbing massager 7 capable of performing a grabbing massage on user's to-be-massaged area, whereas the other end side of the grabbing massage member 8 is coupled to the front end side of the crank member 26. As is the case with the kneading massage member 2, a single grabbing massage member 8 is mounted on each of the right and left sides of the device, and, the left and right grabbing massage members 8L and 8R are arranged in bilaterally line-symmetric relation to each other.

The other end side of the grabbing massage member 8 is divided into two branched parts, and, the front end side of the crank member 26 can be inserted in between these right and left branched ends. Moreover, on the other end side of the grabbing massage member 8, a pivot-pin insertion hole capable of insertion of the pivot pin 27 is formed at each of the two branched ends, so that the pivot pin 27 can be inserted into the pivot-pin insertion holes so as to run along the horizontal direction. The pivot pin 27 is also inserted into an insertion hole formed at the front end side of the crank member 26 so as to pivotally support the grabbing massage member 8 and the crank member 26 for free rotation about a horizontally-directed axis.

Meanwhile, a lengthwise intermediate part of the grabbing massage member 8 (that part of the grabbing massage member 8 which is closer to one end thereof than is the pivot pin 27) is formed with a horizontally extending through hole capable of insertion of the above-described rocking pin 39. The rocking pin 39 for coupling the kneading massage member 2 to the grabbing massage member 8 is inserted in this through hole, so that the kneading massage member 2 and the grabbing massage member 8 can be pivotally supported by the rocking pin 39 for free rotation about a horizontally-directed axis.

Figure 12A:
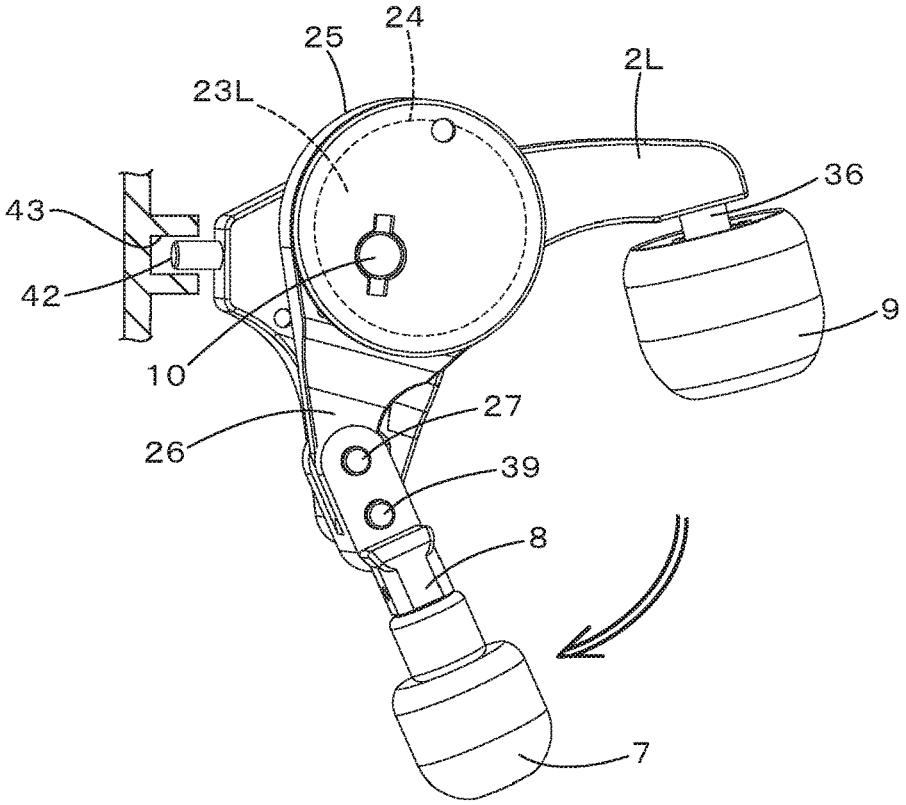
FIG. 12A is a drawing showing the grabbing massage member in a separated state in the third embodiment as seen in side view.
Figure 12B:
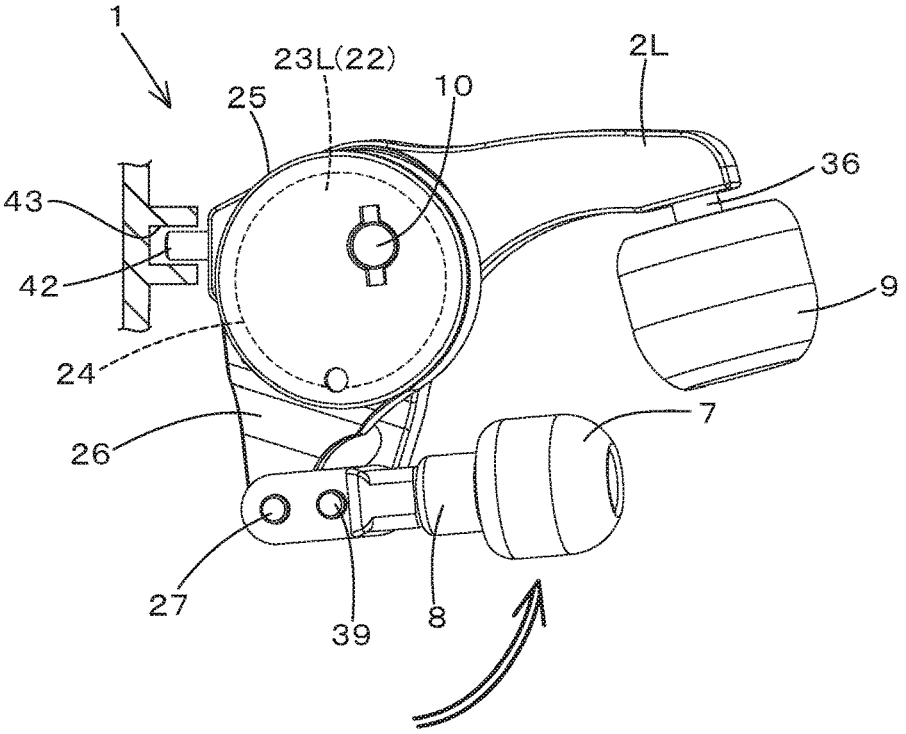
FIG. 12B is a drawing showing the grabbing massage member in an approaching state in the third embodiment as seen in side view.
Figure 13A:
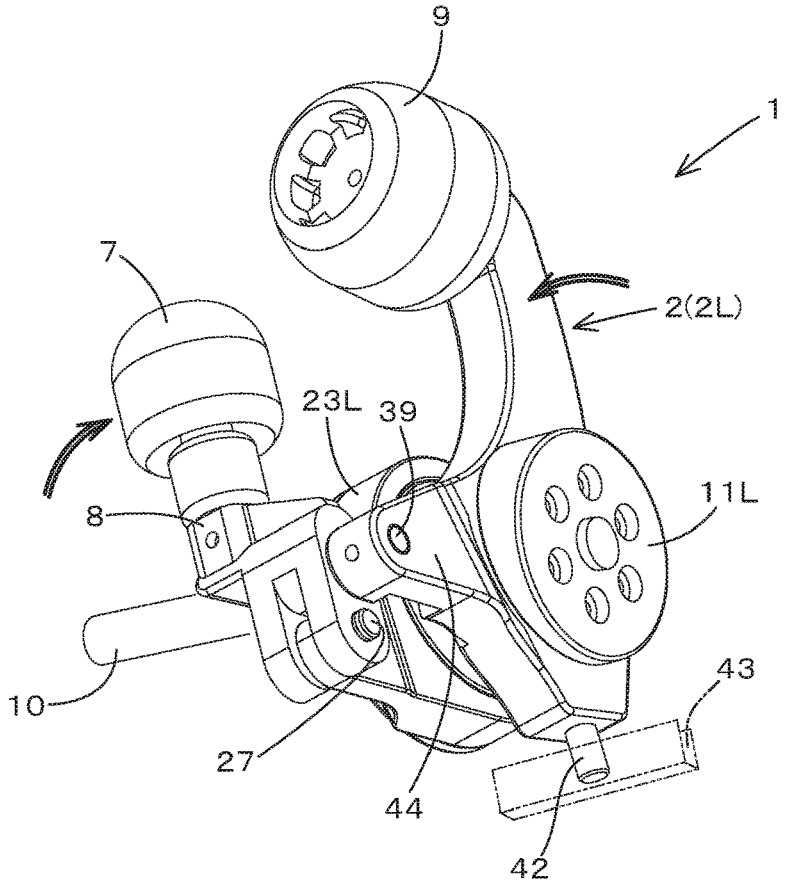
FIG. 13A is a perspective view showing mutually approaching motion of the grabbing massage member and the kneading massage member of the third embodiment.
Figure 13B:
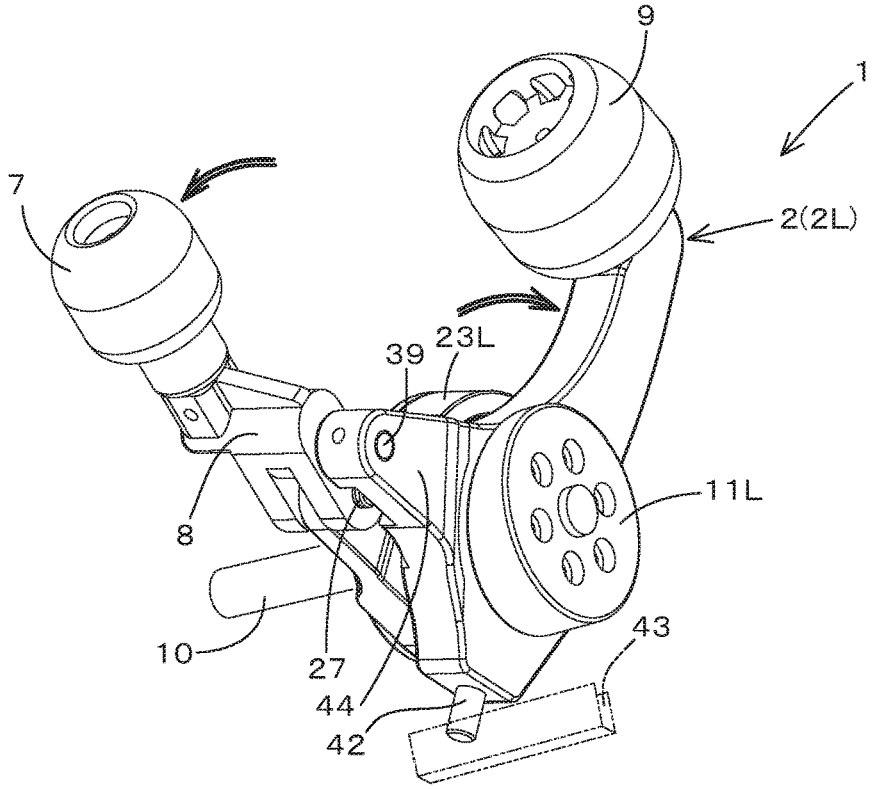
FIG. 13B is a perspective view showing mutually separating motion of the grabbing massage member and the kneading massage member of the third embodiment.

As shown in FIGS. 10A, 12A, and 12B, the grabbing drive section 22 provided in the massage device 1 of the third embodiment includes a grabbing boss portion 23 attached to the rotation shaft 10 for unitary rotation. The outer peripheral surface of the grabbing boss portion 23 is formed with a cam face 24 with a trackway which is eccentric and inclined with respect to the axis of the rotation shaft 10. The cam face 24 of the grabbing boss portion 23 is engaged with an annular engagement portion 25 for taking out a rotative driving force of the rotation shaft 10 via the grabbing boss portion 23. Moreover, the annular engagement portion 25 is disposed on the base end side of the crank member 26 for unitary rotation with the crank member 26, and, the crank member 26 has the capability of transmitting a rotative driving force taken out by the annular engagement portion 25 at the base end side toward the front end side (toward the grabbing massage member 8 at the front end side).

The above-described grabbing boss portion 23 is a short cylindrical member having a large diameter, and, the rotation shaft 10 passes through the grabbing boss portion 23 in the horizontal direction at a position offset from the center of the grabbing boss portion 23 toward the outer circumference thereof. Moreover, like the inclined cam face 16 of the kneading boss portion 11, the cam face 24 with a trackway inclined with respect to the axis of the rotation shaft 10 is formed on the outer peripheral surface of the grabbing boss portion 23. Specifically, the rotation shaft 10 is intersected by the axis of the grabbing boss portion 23 with inclination, and in eccentric relation to the axis. Note that the grabbing boss portion 23 is placed so that the direction of its inclination with respect to the rotation shaft 10 is the same as the direction of inclination of the kneading boss portion 11 with respect to the rotation shaft 10 in any part in the circumferential direction.

The above-described crank member 26 is substantially a member constructed of a combination of the cylindrically shaped annular engagement portion 25 and a platy member extending radially outwardly from the outer peripheral surface of the annular engagement portion 25, and, the cylindrical annular engagement portion 25, which can be engaged with the cam face 24 of the grabbing boss portion 23, is situated on the base end side of the crank member. The annular engagement portion 25 is a cylindrical member which can be externally fitted loosely to the above-described cam face 24, and is attached for free rotation relatively to the cam face 24.

Moreover, the earlier described insertion hole for insertion of the pivot pin 27 is formed in the front end of the crank member 26 extending radially outwardly from the annular engagement portion 25 so as to pass through the crank member 26 in the horizontal direction, and, upon insertion of the pivot pin 27 in the insertion hole and the pivot-pin insertion hole in communicating condition, the base end side of the grabbing massage member 8 can be coupled to the front end side of the crank member 26 for free rotation about a horizontally-directed axis.

In order to perform a grabbing massage with use of the massage device 1 of the third embodiment, to begin with, the rotation shaft 10 is driven to rotate about a horizontally-directed axis by means of a drive motor (kneading drive motor 15) or otherwise. In response to the rotation of the rotation shaft 10 about the horizontally-directed axis, the kneading boss portion 11 and the grabbing boss portion 23, being attached to the rotation shaft 10, are rotated unitarily with the rotation shaft 10.

At this time, since the inclined cam face 16 of the kneading boss portion 11 has a trackway inclined with respect to the axis of the rotation shaft 10, upon rotation of the rotation shaft 10, the kneading boss portion 11 is rotated, with the inclined cam face 16 following a trackway such as to swing in the horizontal direction. However, the rotation shaft 10 is mounted so as to pass close to the axis of the kneading boss portion 11, and there is thus no noticeable eccentricity. Therefore, the inclined cam face 16, while meandering in the horizontal direction, undergoes little change in trackway in the radial direction.

However, in contrast to the above-described kneading boss portion 11, the cam face 24 of the grabbing boss portion 23 is, in addition to being inclined to the axis of the rotation shaft 10, eccentric with respect to the axis, and, the rotation shaft 10 passes through a position of the grabbing boss portion 23 offset from the center toward the outer circumference thereof. Therefore, upon rotation of the rotation shaft 10, the cam face 24 meanders in the horizontal direction as does the inclined cam face 16, and also undergoes a change in trackway in the radial direction, with the consequence that the grabbing boss portion 23 is rotated eccentrically about the axis of the rotation shaft 10.

However, the front end side of the crank member 26 externally fitted to the grabbing boss portion 23 as above described is pivotally supported by the pivot pin 27 located on the base end side of the grabbing massage member 8, and, the grabbing massage member 8 is coupled, via the rocking pin 39 disposed in a lengthwise intermediate part thereof, to the front end side of the protrusion 44 of the kneading massage member 2. Therefore, the front end side of the crank member 26, while being able to rock about a horizontally-directed axis to a certain extent at a pivotal point defined by the rocking pin 39, is restrained against rotation about the axis of the rotation shaft 10 together with the grabbing boss portion 23. In consequence, in the crank member 26 externally fitted to the grabbing boss portion 23, the distance from the axis of the rotation shaft 10 to the front end of the crank member 26 (pivot pin 27) varies endways, and, in response to the rotation of the rotation shaft 10, the crank member 26 moves forward and upward for advancement, and moves backward and downward for retraction.

For example, as shown in FIG. 12A, when the rotation shaft 10 and the grabbing boss portion 23 in eccentric relation are rotated together with the consequence that the crank member 26 moves forward and upward, the front end side of the crank member 26 is lifted forward. Then, the location of the pivot pin 27 is shifted forward and upward, whereupon the grabbing massage member 8 is rocked in a direction to swing the grabbing massager 7 down about the rocking pin 39 (in a direction indicated by an arrow shown in FIG. 12A). Then, in response to the downward rocking motion of the grabbing massage member 8, the grabbing massager 7 attached to the front end of the grabbing massage member 8 moves away from the kneading massager 9.

In contrast, as shown in FIG. 12B, when the grabbing boss portion 23 is further rotated with the consequence that the crank member 26 moves backward and downward, the front end side of the crank member 26 is pushed backward. Then, the location of the pivot pin 27 is shifted backward and downward, whereupon the grabbing massage member 8 is rocked in a direction to swing the grabbing massager 7 up about the rocking pin 39 (in a direction indicated by an arrow shown in FIG. 12B). Then, in response to the upward rocking motion of the grabbing massage member 8, the grabbing massager 7 attached to the front end of the grabbing massage member 8 moves close to the kneading massager 9.

That is, in the massage device of the third embodiment, in response to the rotation of the rotation shaft 10, the grabbing massage member 8 is switched between a separating-state position and an approaching-state position, thereby allowing the grabbing massager 7 to move close to and away from the kneading massager 9. Thus, a grabbing massage can be performed on user's to-be-massaged area by grabbing the area between the kneading massager 9 and the grabbing massager 7.

In the massage device 1 of the third embodiment thus far described, the kneading massage member 2 is designed so that the kneading massager 9 is attached to the upper end of its part extending upward with reference to the rotation shaft 10, and the base end of the grabbing massage member 8 is attached to the lower end of its part extending downward with reference to the rotation shaft 10 (the front end of the protrusion 44). Accordingly, as compared with the first and second embodiments in which the kneading massager 9 and the grabbing massage member 8 are arranged on the same side, with the rotation shaft 10 lying between them, in the massage device 1 of the third embodiment, a longer distance can be secured between the grabbing massager 7 and the kneading massager 9 in the vertical direction, as well as in the front-rear direction. That is, the following advantage is gained: when the grabbing massager 7 is moved close to and away from the kneading massager 9, a wider range of rocking motion of the grabbing massager 7 can be ensured in the vertical direction, wherefore the strength of a massage to be performed on a to-be-massaged area can be increased by an amount corresponding to the extent of widening the rocking range.

It should be understood that the embodiments as set forth hereinabove are considered in all respects as illustrative only and not restrictive. Particularly, as to particulars that are not explicitly specified in the embodiments as disclosed hereinabove, for example, as to working conditions, operating conditions, relevant parameters, and the dimensions, weights, and volumes of constituent components, values that do not depart from the scope of the invention to be fulfilled by those skilled in the art and are easily conceivable by persons having ordinary skill in the art are adopted.

EXPLANATION OF REFERENCE SYMBOLS

1 massage device
2L left-side kneading massage member
2R right-side kneading massage member
3 back-kneading device
4 base member
5 up-and-down moving mechanism
6 kneading drive section
7 grabbing massager
8 grabbing massage member
9 kneading massager
10 rotation shaft
11L left-side kneading boss portion
11R right-side kneading boss portion
12 kneading engagement portion
13 bearing tool
14 drive gear
15 kneading drive motor
16 inclined cam face
17 swing restraining mechanism
18 universal joint portion
19 hole for receiving universal joint portion
20 crank arm
21 tapping drive shaft
22 grabbing drive section
23L left-side grabbing boss portion
23R right-side grabbing boss portion
24 cam face
25 annular engagement portion
26 crank member
27 pivot pin
28 slot
29 coupling pin
30 boss insertion hole
31 guide pin
32 guide groove
33 guide member
34 rotary shaft
35 coupling member
36 massager support shaft
39 rocking pin
42 restraint projection
43 guide slot
44 protrusion

The invention claimed is:

1. A massage device comprising:

a kneading massage member having a kneading massager at its front end;

a grabbing massage member having a grabbing massager at its front end, which is disposed on a base end side of the kneading massage member, said grabbing massage member being designed to perform a grabbing massage by moving the grabbing massager of the grabbing massage member close to and away from said kneading massager;

a rotation shaft which is driven to rotate about an axis pointing in a horizontal direction;

a kneading drive section for rocking said kneading massage member by converting a rotative driving force of said rotation shaft to allow the kneading massage member to perform a kneading massage; and a grabbing drive section for moving said grabbing massager close to and away from the kneading massager by utilizing the rotative driving force of said rotation shaft, wherein said grabbing drive section comprises:

a grabbing boss portion having a cam face formed on its outer peripheral surface, which is eccentrically attached to said rotation shaft; and an annular engagement portion engaged with the cam face of said grabbing boss portion, for converting said rotative driving force to a back and forth movement, and wherein a portion of the grabbing massage member is movably mounted to the kneading massager, and the grabbing drive section transmits rotative driving force form the cam face to move the grabbing massager close to and away from the kneading massager.

2. The massage device according to claim 1, wherein said grabbing drive section further comprises:

a crank member having its base end connected to said annular engagement portion, and has its front end connected to said grabbing massage member, for transmitting the produced rotative driving force to said grabbing massage member, wherein, in said grabbing massage member, its base end is pivotally supported on said kneading massage member for free rotation about a horizontal axis relative to its front end fitted with said grabbing massager, and wherein the front end of said crank member is coupled to an intermediate part of said grabbing massage member for free rotation about an axis pointing in the 25 horizontal direction.

3. The massage device according to claim 1, wherein said grabbing drive section further comprises:

a guide pin formed in said kneading massage member or said grabbing massage member; a guide groove formed in said grabbing massage member or said kneading massage member, in which said guide pin is slidably moved; and a coupling member having its base end connected relatively to said annular engagement portion, and having its front end connected for free rotation about a horizontal axis relatively to the base end of the grabbing massage member.

4. The massage device according to claim 3, wherein said kneading drive section comprises:

a kneading boss portion which is attached to the rotation shaft fitted with said grabbing boss portion, and has, on its outer peripheral surface, an inclined cam face inclined with respect to an axis of said rotation shaft; and a kneading engagement portion engaged with the inclined cam face of said kneading boss portion, wherein said kneading engagement portion is formed at a base end of said kneading massage member, and wherein a swing restraining mechanism for restraining said kneading massage member against co-rotation with the kneading boss portion is disposed on a lateral side of the base end of said kneading massage member.

5. The massage device according to claim 4, wherein said kneading boss portion is eccentrically attached to said rotation shaft, and wherein an eccentric direction of the grabbing boss portion with respect to said rotation shaft and an eccentric direction of the kneading boss portion with respect to said rotation shaft are circumferentially different from each other.

6. The massage device according to claim 1, wherein said kneading massager comprises an inner kneading massager and outer kneading massager located at each side of the front end of the kneading massage member in a width direction, and wherein a grabbing massage is performed by moving the grabbing massager close to and away from the inner kneading massager.

7. The massage device according to claim 1, wherein said grabbing drive section further comprises:

a crank member which has, at its base end side, the annular engagement portion transmits the produced rotative driving force toward a front end side of the crank member, wherein said grabbing massage member has its base end side pivotally supported on the front end side of said crank member for free rotation about a horizontal axis, and said grabbing massager is disposed at the front end side of said grabbing massage member, and wherein an intermediate part of said grabbing massage member is coupled to said kneading massage member for free rotation about an axis pointing in the horizontal direction.

8. The massage device according to claim 7, wherein said kneading drive section comprises:

a kneading boss portion which is attached to the rotation shaft fitted with said grabbing boss portion, and has, on its outer peripheral surface, an inclined cam face inclined with respect to the axis of said rotation shaft; and a kneading engagement portion engaged with the inclined cam face of said kneading boss portion, wherein said kneading engagement portion is formed at the base end of said kneading massage member, and the kneading massager is disposed at the front end of the kneading massage member, and wherein the base end of said kneading massage member is formed with a protrusion extending in the opposite direction to said kneading massager with reference to said rotation shaft, and said grabbing massage member is 20 coupled to a front end of said protrusion.

* * * * *